US010157605B2

(12) United States Patent
Maeda et al.

(10) Patent No.: US 10,157,605 B2
(45) Date of Patent: Dec. 18, 2018

(54) NOISE REDUCTION DEVICE

(71) Applicant: Panasonic Intellectual Property Management Co., Ltd., Osaka (JP)

(72) Inventors: Tsuyoshi Maeda, Hyogo (JP); Yoshifumi Asao, Hyogo (JP); Masaaki Higashida, Osaka (JP); Mitsuhiro Tosa, Osaka (JP); Kaname Tomita, Osaka (JP); Toshihide Abe, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/381,546

(22) Filed: Dec. 16, 2016

(65) Prior Publication Data

US 2017/0186417 A1 Jun. 29, 2017

Related U.S. Application Data

(60) Provisional application No. 62/271,285, filed on Dec. 27, 2015.

(51) Int. Cl.

| | |
|---|---|
| ***G10K 11/16*** | (2006.01) |
| ***G10K 11/178*** | (2006.01) |
| ***H04R 1/02*** | (2006.01) |

(52) U.S. Cl.

CPC ..... *G10K 11/178* (2013.01); *G10K 11/17857* (2018.01); *H04R 1/023* (2013.01);

(Continued)

(58) Field of Classification Search

CPC ..... H04R 5/02; H04R 1/023; H04R 1/025; H04R 2201/021; H04R 2499/13; H04R 1/1083; H04R 2410/05; H04R 2410/07; H04R 1/08; H04R 1/02; H04R 1/083; H04R 1/406; H04R 1/222; H04R 1/342; H04R 1/38; H04R 2201/023; H04R 11/04; H04R 17/02; H04R 21/02; H04R 9/08; H04R 2430/20; G10K 2210/1281; G10K 2210/1283; G10K 2210/3027; G10K 2210/3044; G10K 11/16; G10K 11/175; G10K 11/178; G10K 11/1782;

(Continued)

(56) References Cited

U.S. PATENT DOCUMENTS 4,208,071 A * 6/1980 Pesiri ..... B60N 2/22 297/301.4
6,219,645 B1 * 4/2001 Byers ..... G10L 15/02 381/91

(Continued)

FOREIGN PATENT DOCUMENTS

| | | | |
|---|---|---|---|
| JP | H07-160280 | A | 6/1995 |
| JP | H10-171468 | A | 6/1998 |
| JP | 2010-188752 | A | 9/2010 |

*Primary Examiner* — Leshui Zhang
(74) *Attorney, Agent, or Firm* — McDermott Will & Emery LLP

(57) ABSTRACT

A noise reduction device is used together with a shell which surrounds at least a part of the periphery of reclinable seat. The device includes a plurality of noise microphones, a noise controller, and control speakers. Control speakers output a sound based on a control-sound signal that is generated by the noise controller. Each of noise microphones is accommodated in back wall configuring the shell and is set back from a surface of the back wall.

20 Claims, 40 Drawing Sheets

(52) U.S. Cl.
CPC ..... *H04R 1/025* (2013.01); *G10K 2210/1281* (2013.01); *G10K 2210/1283* (2013.01); *G10K 2210/3027* (2013.01); *G10K 2210/3044* (2013.01); *H04R 2201/021* (2013.01); *H04R 2499/13* (2013.01)

(58) Field of Classification Search
CPC ..... G10K 11/1784; G10K 11/1786; G10K 11/1788; G10K 2210/10; G10K 2210/105; G10K 2210/1051; G10K 2201/1052; G10K 2201/1053; G10K 2201/1054; G10K 2201/128; G10K 2201/1281; G10K 2201/1282; G10K 2201/12821; G10K 2201/12822; G10K 2201/1283; H04B 3/20; H04B 3/23; H04M 3/002; H04M 3/56; H04M 9/08; H04M 9/082; G10L 19/012
USPC ..... 381/73.1, 71.4, 355, 358, 359, 360, 361, 381/364, 365, 366, 368, 71.1–71.14, 92, 381/122; 700/94; 379/406.01–406.16
See application file for complete search history.

(56) References Cited

U.S. PATENT DOCUMENTS

| | | | | |
|---|---|---|---|---|
| 2009/0010446 | A1* | 1/2009 | Nakane | G10K 11/178 381/71.5 |
| 2010/0208911 | A1* | 8/2010 | Maeda | G10K 11/1782 381/73.1 |
| 2012/0051548 | A1* | 3/2012 | Visser | G10L 21/0208 381/56 |
| 2012/0070020 | A1* | 3/2012 | Kano | G10K 11/178 381/122 |

* cited by examiner

Noise microphones, 10-units
$d_{max}$-$d_{min}$> $\lambda/2$

Noise microphones, 12-units
$d_{max}$-$d_{min}$< $\lambda/2$

NOISE REDUCTION DEVICE

RELATED APPLICATIONS

This application claims the benefit of U.S. Provisional Application No. 62/271,285, filed on Dec. 27, 2015, the disclosure of which is incorporated by reference herein.

BACKGROUND

1. Technical Field

The present disclosure relates to noise reduction devices used on the insides of closed-structure bodies including aircraft and railway vehicles, for example.

2. Description of the Related Art

Japanese Patent Unexamined Publication No. H07-160280 discloses the method of enhancing an effect of eliminating low-frequency components of a noise, which is applied to silencers for electrical equipment such as air conditioners. The enhancement is achieved by taking consideration of, in the silencers, installation positions of a microphone and speaker, and a delay time between time of noise propagation and time of emitting a control sound from the speaker.

Japanese Patent Unexamined Publication No. H10-171468 discloses the method of enhancing an effect of silencing a random noise. The enhancement is achieved by taking consideration of an installation position of a speaker relative to a place (referred to also as "silencing center" or "control point," hereinafter) where the noise is reduced.

Japanese Patent Unexamined Publication No. 2010-188752 discloses the method of effectively exhibiting an effect of reducing a noise even under circumstances that the time causality constraints are not satisfied because of an unfavorable positional relation between a noise-detecting microphone and speaker and the silencing center. Such an effect is achieved by setting a control upper-limit frequency.

SUMMARY

A noise reduction device according to the present disclosure is intended to be used together with a shell which surrounds at least a part of the periphery of a reclinable seat. The noise reduction device includes a plurality of noise detecting units, a noise controller, and a control-sound outputting unit. The plurality of the noise detecting units detects a noise. The noise controller generates a control-sound signal to reduce the noise, at a control center of a control space, with the noise being detected by the noise detecting units. The control-sound outputting unit outputs a sound based on the control-sound signal. Each of the noise detecting units is accommodated in a wall configuring the shell and is set back from a surface of the wall.

BRIEF DESCRIPTION OF DRAWINGS

FIG. 24A is an elevational view of a back wall of FIGS. 23A and 23B, with the view illustrating an example of the arrangement of speakers, noise microphones, error microphones, and the like;

FIG. 24B is an elevational view of side walls of FIGS. 23A and 23B, with the view illustrating an example of the arrangement of speakers, noise microphones, error microphones, and the like;

DETAILED DESCRIPTION

Hereinafter, detailed descriptions of embodiments will be made with reference to the accompanying drawings as deemed appropriate. However, descriptions in more detail than necessary will sometimes be omitted. For example, detailed descriptions of well-known items and duplicate descriptions of substantially the same configuration will sometimes be omitted, for the sake of brevity and easy understanding by those skilled in the art. Note that the accompanying drawings and the following descriptions are presented to facilitate fully understanding of the present disclosure by those skilled in the art, and are not intended to impose any limitations on the subject matter described in the appended claims.

First Exemplary Embodiment

A device according to a first embodiment of the present disclosure will be described as below, with reference to FIGS. 1 to 7.

Hereinafter, a description is made using a case where a noise reduction device according to the embodiment is installed in aircraft 100.

Figure 1:
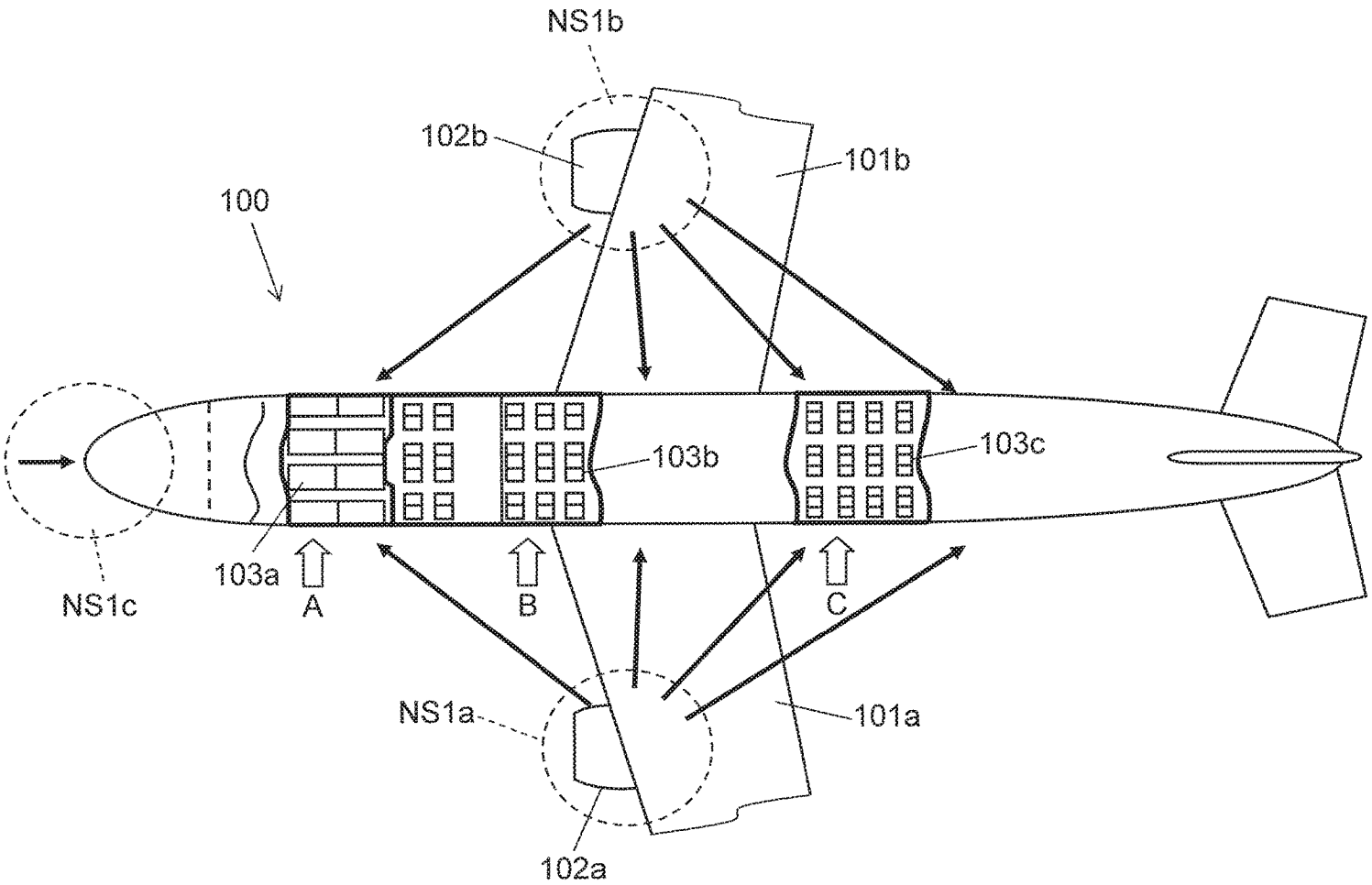
FIG. 1 is a plan view of a configuration of a cabin of an aircraft in which a noise reduction device is installed according to an embodiment of the present disclosure.
Figure 2:
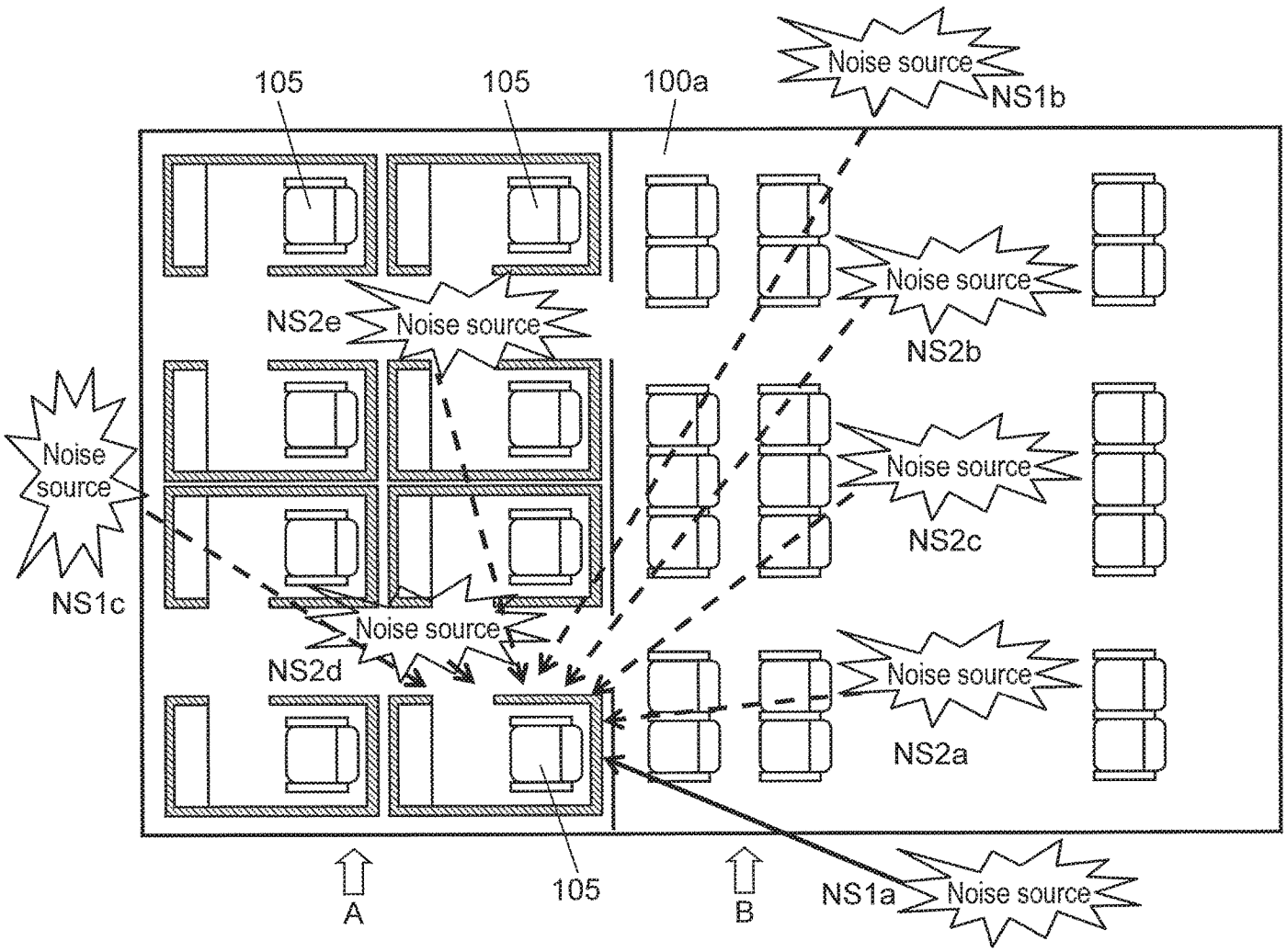
FIG. 2 is an enlarged plan view of the configuration of the cabin shown in FIG. 1.

First, a sound environment in aircraft 100 is described which requires installation of the noise reduction device, with reference to FIGS. 1 and 2.

FIG. 1 is a plan view illustrating the environment (on the inside of aircraft 100) in which the noise reduction device is installed according to the embodiment.

Aircraft 100 includes, as shown in FIG. 1, left and right wings 101*a* and 101*b*, and engines 102*a* and 102*b* mounted to wings 101*a* and 101*b*, respectively.

Here, in view of the sound environment of the space inside aircraft 100, sounds emitted from engines 102*a* and 102*b* play an important role as noise sources because they contain sounds associated with reverberations of air streams during a flight as well as rotation sounds.

Engines 102*a* and 102*b* act as external noise sources NS1*a* and NS1*b* for seat rows 103*a*, 103*b*, and 103*c* which are arranged in cabin A (e.g. first class), cabin B (e.g. business class), and cabin C (e.g. economy class) of the aircraft, respectively, for example. Moreover, high speed travelling of aircraft 100 entails an air-stream collision noise (wind noise) with both the airframe's nose cone, and wings 101*a* and 101*b*. Such a collision noise also acts as noise source NS1*c* for the cabin, resulting in bad influence on information service and the like in the cabin.

FIG. 2 is a plan view illustrating details of the environment in which the noise reduction device is installed, showing an enlarged illustration of the seat arrangement in a part of cabins A and B shown in FIG. 1.

Cabin 100*a* is sectioned by walls into cabin A and cabin B. In cabins A and B, sat rows 103*a*, 103*b* are disposed, respectively.

As to the sound environment in cabin 100*a*, the external noise sources include: noise sources NS1*a* and NS1*b* caused by engines 102*a* and 102*b*, and the wind noise (noise source NS1*c*) generated at the airframe's nose cone. In addition, noise sources NS2*a* to NS2*e* are present on the inside of cabin 100*a*, which are caused by air conditioners and the like.

Here, a case is considered where one seat 105 arranged in cabin A suffers from the noises caused by these noise sources. Seat 105 is influenced by the noises including: ones from noise sources NS1*a* to NS1*c* caused by the air stream sound and engine 102*a*, 102*b* (see FIG. 1) mounted to the wing outside the window, and ones from noise sources NS2*a* to NS2*e* caused by the air conditioner.

In particular, seat 105 in cabin A has a shell structure, e.g. in the first class and like shown in FIG. 1. Such a shell is equipped with audio-visual appliances such as a television and radio receivers for enjoying movies and music, a desk for a businessperson, a power receptacle for PCs, and so on, in the shell's inside. Moreover, seat 105 in such as the first class is strongly required to offer a passenger an excellent environment for relaxing comfortably, concentrating on business, etc. For this reason, noise reduction inside the shell structure has been strongly demanded.

Figure 3B:
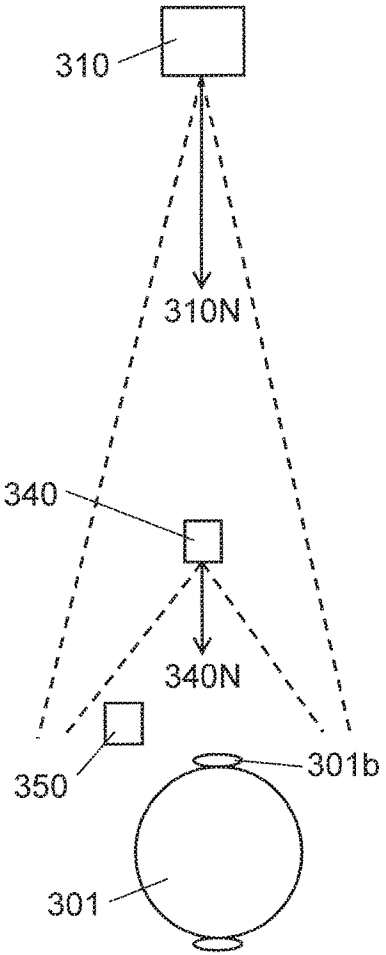
FIG. 3B is a view illustrating a method of superimposing a control sound emitted from a control-sound generating unit onto a noise emitted from a noise source.
Figure 3A:
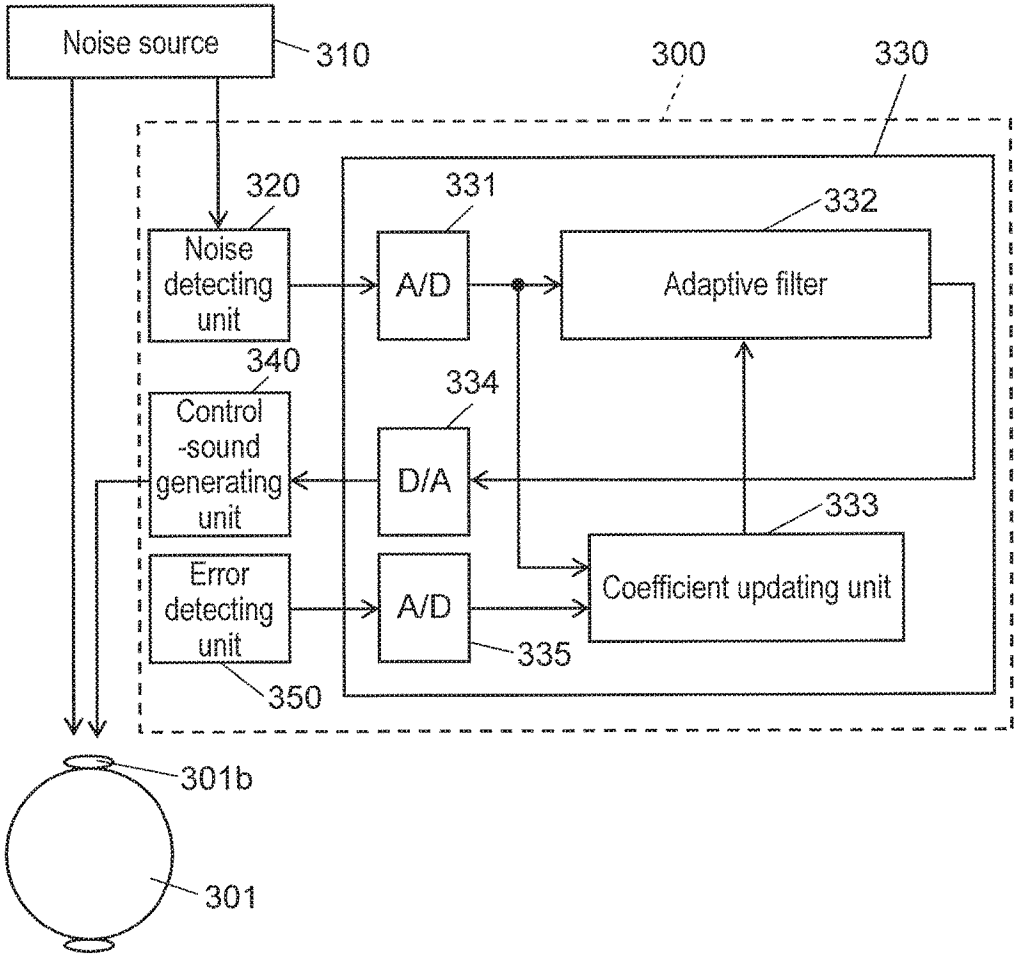
FIG. 3A is a block diagram of a basic configuration of the noise reduction device installed in the aircraft shown in FIG. 1.

FIG. 3A is a block diagram of a basic configuration of the noise reduction device according to the embodiment.

Noise reduction device 300 is a feed-forward noise reduction device (see FIG. 5), and includes noise detecting unit 320, noise controller 330, control-sound generating unit 340, and error detecting unit 350, as shown in FIG. 3A.

Hereinafter, configurations and functions of these units are described.

Noise detecting unit 320 is a microphone for detecting a noise emitted from noise source 310 (such a microphone is referred simply to as a noise microphone, hereinafter), which converts the detected noise information into an electric signal and then outputs it.

Error detecting unit 350 is a microphone for detecting a residual sound (error sound) which is formed by superimposing a control sound emitted from control-sound generating unit 340 onto the noise emitted from noise source 310 (such a microphone is referred simply to as an error microphone, hereinafter). The error microphone converts the error sound into an electric signal and then outputs it.

As shown in FIG. 3A, noise controller 330 includes A/D converters 331 and 335, adaptive filter 332, coefficient updating unit 333, and D/A converter 334. Then, noise controller 330 generates a control-sound signal such that the detected error is minimized, based on both noise information from noise detecting unit 320 and error information from error detecting unit 350.

Control-sound generating unit 340 is a speaker for converting the control-sound signal, which is received from D/A converter 334, into a sound wave and outputting it. This sound output from the speaker is the control sound having the opposite phase to the noise which reaches the proximity of ear 301*b* of user 301, thereby canceling the noise.

Adaptive filter 332 is configured including multistage taps, and is a finite impulse response (FIR) filter capable of freely setting a filter coefficient of each tap. Coefficient updating unit 333 is fed, via A/D converter 335, with a detected-error signal from error detecting unit 350, as well as the information output from noise detecting unit 320. Then, coefficient updating unit 333 adjusts each of the filter coefficients of adaptive filter 332 such that the detected error is minimized. That is, the adaptive filter generates the control-sound signal which will have the opposite phase to the noise from noise source 310 at the installation position of error detecting unit 350, and outputs the resulting signal to control-sound generating unit 340 via D/A converter 334.

A/D converter 331 applies A/D conversion to the noise signal from noise detecting unit 320, and outputs the resulting signal to both adaptive filter 332 and coefficient updating unit 333.

Error detecting unit 350 detects a post-reduction noise as an error, and feeds the error back into the operation result of noise reduction device 300. This operation allows the noises to be always minimized at the positions of the user's ears even if the noise environment and the like changes.

In noise reduction device 300 according to the embodiment, as shown in FIG. 3A, noise detecting unit 320 detects the noise emitted from noise source 310. Then, in noise reduction device 300, noise controller 330 performs signal processing of the noise signal. Then, control-sound generating unit 340 emits, to ear 301*b* of user 301, the control sound having the opposite phase to the noise emitted from noise source 310, with the control sound being superimposed onto the noise. This operation causes the control sound having the opposite phase and the noise to cancel each other, resulting in the reduced noise.

FIG. 3B illustrates a method of superimposing the control sound emitted from control-sound generating unit 340 onto the noise emitted from noise source 310.

As shown in FIG. 3B, control-sound generating unit 340 is disposed on principal reaching path 310N of the noise, with the path connecting between noise source 310 and ear 301*b* of user 301.

With this configuration, the control sound having the opposite phase relative to the noise is emitted along principal reaching path 340N, which allows the control sound to reach ear 301*b* of user 301, with the control sound being superimposed onto the noise. Moreover, error detecting unit 350 is disposed within a region of the superimposition. This allows the error detecting unit to detect the post-reduction sound, as an error, and to feed it back into the operation result of noise reduction device 300, thereby enhancing the noise reduction effect.

Figure 4:
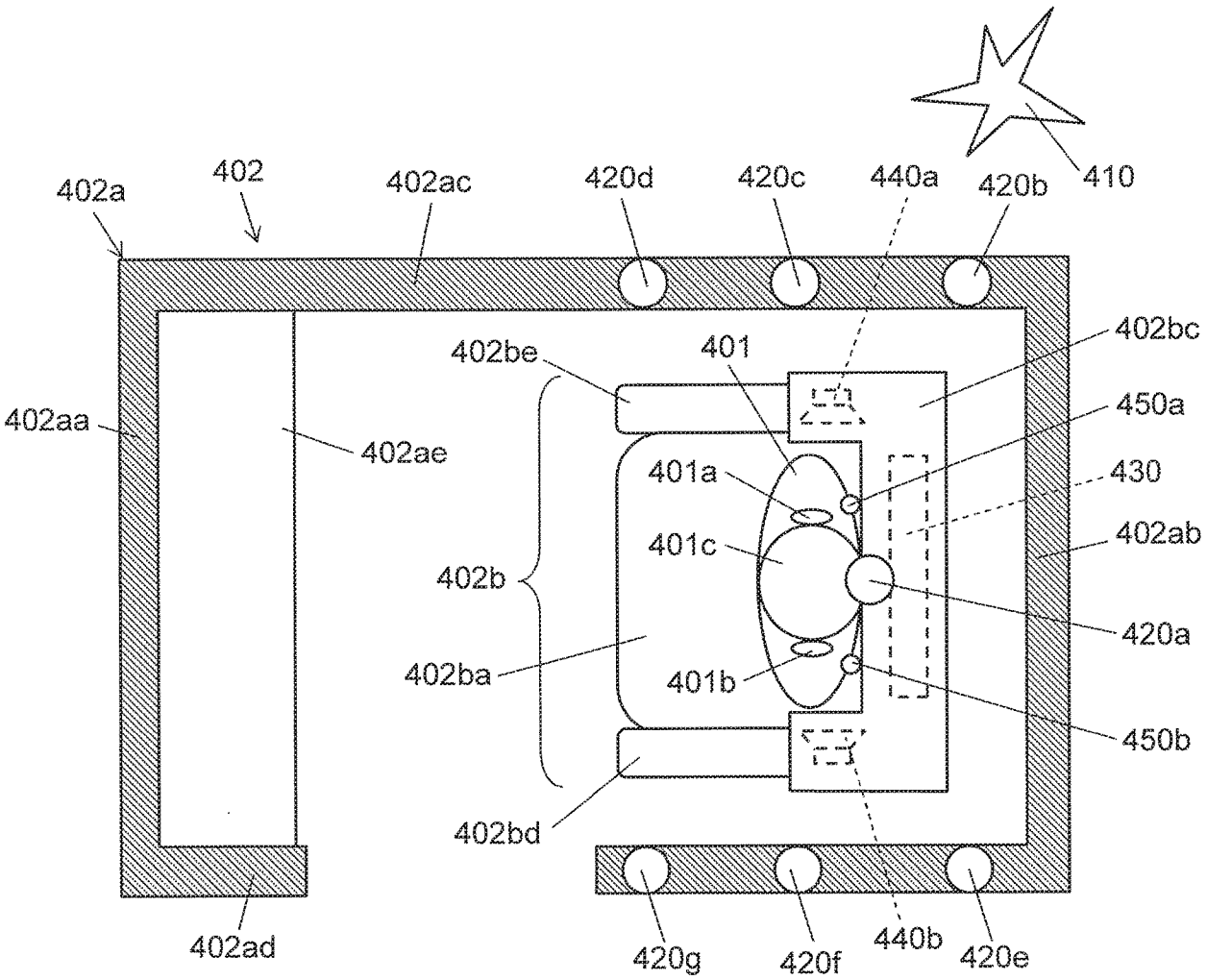
FIG. 4 is a plan view of an example of an arrangement of the noise reduction device installed around a seat in the cabin of the aircraft shown in FIG. 1.
Figure 5:
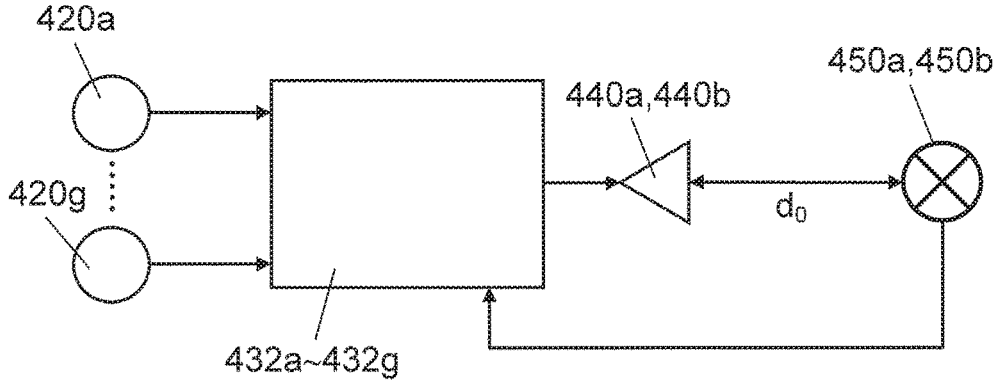
FIG. 5 is a block diagram of a basic configuration of a feed-forward noise reduction device.

Next, the noise reduction device according to the embodiment will be described for the case where the device is disposed in the cabin of an aircraft, with reference to FIGS. 4 and 5. FIG. 4 is a plan view of a principal configuration of the noise reduction device installed in the cabin of the aircraft. Moreover, FIG. 5 is a block diagram of a basic configuration of the feed-forward noise reduction device corresponding to the noise reduction device shown in FIG. 4.

The noise reduction device is arranged in cabin A (FIG. 1) of the aircraft, and disposed in seat 402 serving as a control space in which the noise is controlled.

Seat 402 includes: shell 402*a* surrounded with wall surfaces to define a shell-like space for a private area of the user, and seat part 402*b* disposed on the inside of shell 402*a*.

Shell 402*a* is surrounded, from four directions, with front wall 402*aa*, back wall 402*ab*, side wall 402*ac*, and side wall 402*ad*.

In side wall 402*ad*, an opening is formed for the user to come into and go out from shell 402*a*.

Moreover, shell 402*a* is equipped with shelf 402*ae* in front of seat part 402*b*, at a position surrounded by front wall 402*aa* and side walls 402*ac* and 402*ad*. Shelf 402*ae* is used as a desk.

Seat part 402*b* includes: a backrest (not shown), seat cushion 402*ba* on which user 401 is seated, headrest 402*bc*, and armrests 402*bd* and 402*be*. Moreover, on the inside of the backrest of seat part 402*b*, noise controller 430 (corresponding to noise controller 330 shown in FIG. 3A) is disposed.

As to the sound environment in cabin A of the aircraft, the noise sources involve engines 102*a* and 102*b* mounted to the airframe, the air conditioners installed inside the cabin, and the like. In the proximity of seat 402, the noises from these noise sources reach the periphery of shell 402*a*.

As shown in FIG. 4, for example, seat 402 is physically insulated from the noises emitted from external noise sources 410, by shell 402*a* surrounding the periphery of seat 402. Moreover, the noises having entered the inside of shell 402*a* from noise sources 410 will reach the proximity of head 401*c* of user 401 being seated on seat part 402*b*.

Note that, in cases where the principal reaching path is difficult to specify due to the presence of such various kinds of noise sources as those in an aircraft, a plurality of nondirectional noise microphones is disposed in shell 402*a* (control space) or the proximity of the shell.

FIG. 4 shows the case where there are disposed, at predetermined positions in shell 402*a*, noise microphones 420*a* to 420*g* (corresponding to noise detecting unit 320 shown in FIG. 3A), and where there are disposed, in the seat, both control speakers 440*a* and 440*b* (corresponding to control-sound generating unit 340 shown in FIG. 3A) and error microphones 450*a* and 450*b* (corresponding to error detecting unit 350 shown in FIG. 3A).

In the noise reduction device according to the embodiment, as shown in FIG. 4, the inside of shell 402*a* is defined as the control space in seat 402, and error microphones 450*a* and 450*b* are defined as the control centers, with the error microphones being disposed in the proximity of ears 401*a* and 401*b* of user 401 being seated on seat part 402*b*.

In the noise reduction device, as shown in FIG. 5, a feed-forward configuration is employed which operates as follows. That is, a noise is detected by noise microphones 420*a* to 420*g*, and control sounds having the opposite phase to the noise are emitted from control speakers 440*a* and 440*b* by the time the noise reaches both error microphones 450*a* and 450*b* serving as the control centers, thereby reducing the noise.

Moreover, in the noise reduction device according to the embodiment, as shown in FIG. 4, noise microphone 420*a* (second noise detecting unit) is disposed at a position close to error microphones 450*a* and 450*b*, serving as the control centers, relative to the other noise microphones 420*b* to 420*g* (first noise detecting units). Specifically, the second noise detecting unit is disposed in the proximity of headrest 402*bc* in seat 402.

On the other hand, the other noise microphones 420*b* to 420*g* are disposed in respective side walls 402*ac* and 402*ad* of shell 402*a* covering the periphery of seat 402, with the side walls covering the sides of seat 402.

That is, in the embodiment, in order to effectively perform the reduction processing of the noise that reaches ears 401*a* and 401*b* of user 401 being seated on seat 402, one noise microphone 420*a* is disposed on the inside of shell 402*a* and six noise microphones 420*b* to 420*g* are disposed in side walls 402*ac* and 402*ad* of shell 402*a* surrounding the periphery of seat 402.

Figure 6:
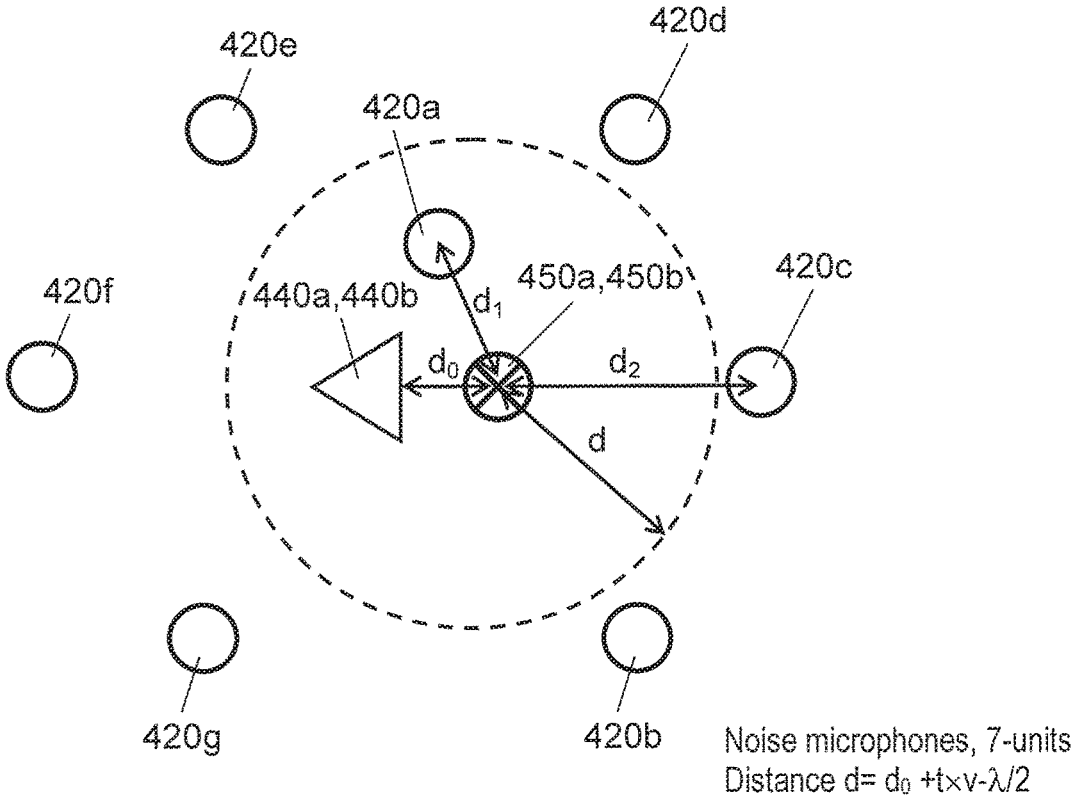
FIG. 6 is a schematic view of an arrangement of noise microphones and the like in the noise reduction device shown in FIG. 4.
Figure 7:
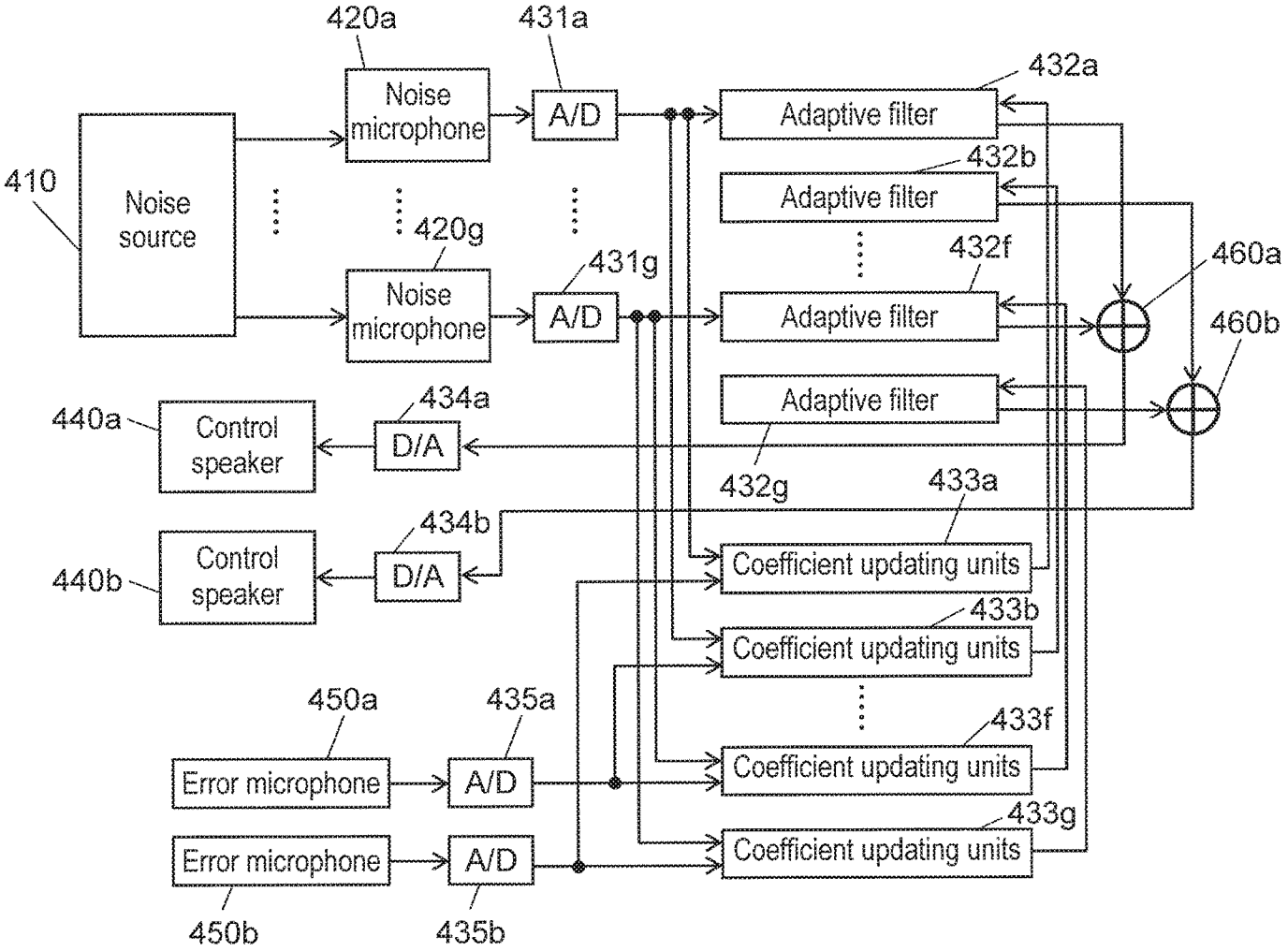
FIG. 7 is a block diagram of a configuration in which pluralities of noise microphones and error microphones are used in the noise reduction device shown in FIG. 3A.

Now, the arrangement positions of these noise microphones 420*a* to 420*g* are described in terms of their distances from the control center, with reference to FIG. 6.

That is, in the noise reduction device of the embodiment, of seven noise microphones 420*a* to 420*g*, only noise microphone 420*a* is disposed at a short distance from the control center (error microphones 450*a* and 450*b*).

Specifically, as shown in FIG. 6, noise microphone 420*a* is disposed at the position that satisfies the following Relational Expressions (1) and (2), where "d0" is a distance of control speakers 440*a* and 440*b* from the control center (error microphones 450*a* and 450*b*), and "d1" is a distance of noise microphone 420*a* from the control center. That is, $$d=d0+t\times v-\lambda/2, \tag{1}$$

$$d1<d. \tag{2}$$

(Note that "t" is a control delay time in the control speaker; "v" is a sound speed; "λ" is a wavelength corresponding to control upper-limit frequency "f." The control delay time in the control speaker corresponds to the sum of a delay time in noise controller 330 and a delay time in control-sound generating unit 340, both shown in FIG. 3A.)

On the other hand, noise microphones 420*b* to 420*g* are disposed at the respective positions that satisfy the following Relational Expression (3), where "d2" is a distance of each of noise microphones 420*b* to 420*g* from the control center, $$d2>d. \tag{3}$$

That is, in the noise reduction device according to the embodiment, noise microphone 420*a* is disposed inside the region (dashed-line circle) defined by distance "d" from the control center, and noise microphones 420*b* to 420*g* are disposed outside the dashed-line circle, as shown in FIG. 6.

Here, effects of the arrangement of the noise microphones are discussed. In general, in cases where the noise microphones are disposed only at close positions to the control center, causality is not satisfied, allowing only a little effect on the degree to which low-frequency (e.g. not higher than 300 Hz) sounds are reduced a little.

In contrast, in cases where the noise microphones are disposed only at distant positions from the control center, the causality is satisfied, allowing a noise reducing effect over a wide frequency band. Unfortunately, such a configuration results in a decrease in correlation between the noise detected by the noise microphones and the noise reaching the control center, causing a problem, that is, a decrease in sound volume by which the noise is reduced.

Given this situation, in the noise reduction device according to the embodiment, distance "d" from the control center is set as a reference, and the noise microphones are disposed at both close and distant positions to and from the control center, relative to the reference distance "d." In addition, the number of noise microphone 420*a* (one unit) disposed at the position closer than distance "d" is smaller than the number of noise microphones 420*b* to 420*g* (six units) disposed at the more distant positions than distance "d."

This configuration allows compatibility of two effects, that is, the effect of satisfying the causality and the effect of enhancing the correlation, resulting in the noise reduction effect over a wide frequency band.

In general, for achieving the same correlation, the required number of the noise microphones is smaller for ones disposed at the close positions than for ones disposed at the distant positions. Besides this, such a correlation determines the amount of noise reduction. Therefore, the number of the noise microphones at close positions can be set to be smaller than the number of the noise microphones at distant positions. With this configuration, even with the smaller total number of these noise microphones, it is possible to achieve the noise reduction effect over the wide frequency band, with costs and complexity of control-signal processing being reduced.

More specifically, in the noise reduction device according to the embodiment, each of noise microphones 420*a* to 420*g* is disposed such that Relational Expressions (1) to (3) described above are satisfied.

With this configuration, the correlation can be held in a high level between the noise detected by noise microphones 420*a* to 420*g* and the noise actually reaching the proximity of the ears of user 401, with the causality in the noise reduction control being satisfied. Therefore, even in cases where many noise sources are present and noises come from various directions, as in the cabin of aircraft 100, it is possible to effectively reduce the noises over a wide frequency band, from lower to higher frequencies.

Note that the noise reducing effect of the noise reduction device according to the embodiment will be described by using the following Example, together with the result of a verification of the effect, by using Comparative Examples.

Here, of noise microphones 420*a* to 420*g*, noise microphones 420*b* to 420*g* disposed more distant than distance "d" from the control center may be intended explicitly for a higher frequency range, while noise microphone 420*a* disposed closer than distance "d" may be intended explicitly for a lower frequency range.

However, in the embodiment, via their filter responses, adaptive filters 432*a* to 432*g* change their configurations automatically such that noise microphone 420*a* disposed at the closer position will operate for reducing mainly low-frequency noises. Accordingly, all adaptive filters 432*a* to 432*g*, which are each disposed at the closer or more distant position than distance "d," can commonly employ wide-band microphones.

In other words, assuming that "f1" is the control upper-limit frequency of noise microphone 420*a* for a lower frequency range and that "f2" is the control upper-limit frequency of noise microphones 420*b* to 420*g* for a higher frequency range, then f1<f2 in actual use.

Incidentally, the control upper-limit frequency of noise microphone 420*a* disposed at the position closer than distance "d" is not higher than 300 Hz, for example.

Next, as described above, the noise reduction device according to the embodiment is configured with the plurality of noise microphones 420*a* to 420*g*, control speakers 440*a* and 440*b*, and error microphones 450*a* and 450*b*. Accordingly, the control block diagram in actual use is one shown in FIG. 7, not so simple as that shown in FIG. 3A.

Note that, noise microphones 420*a* to 420*g*, A/D converters 431*a* to 431*g*, adaptive filters 432*a* to 432*g*, coefficient updating units 433*a* to 433*g*, D/A converters 434*a* and 434*b*, A/D converters 435*a* and 435*b*, control speakers 440*a* and 440*b*, and error microphones 450*a* and 450*b*, respectively correspond to noise detecting unit 320, A/D converter 331, adaptive filter 332, coefficient updating unit 333, D/A converter 334, A/D converter 335, control-sound generating unit 340, and error detecting unit 350 shown in FIG. 3. Accordingly, detailed descriptions of functions of the configurations of these elements are omitted.

In the noise reduction device according to the embodiment, the noise emitted from noise source 410 is detected by each of noise microphones 420*a* to 420*g*.

The noise detected by each of noise microphones 420*a* to 420*g* is converted into a digital signal by respective A/D converters 431*a* to 431*g*, and then inputted to respective adaptive filters 432*a* to 432*g*.

The filter coefficients of each of adaptive filters 432*a* to 432*g* are adjusted, by respective coefficient updating units 433*a* to 433*g*, to minimize the error detected by respective error microphones 450*a* and 450*b*.

The outputs from adaptive filters 432*a* to 432*g* are added, by adders 460*a* and 460*b*, and then transmitted to control speakers 440*a* and 440*b* via D/A converters 434*a* and 434*b*, thereby emitting the control sounds.

Then, the post-noise-reduction sounds detected by error microphones 450*a* and 450*b* are converted into digital signals by respective A/D converters 435*a* and 435*b*, and transmitted to respective coefficient updating units 433*a* to 433*g* which adjust the filter coefficients of respective adaptive filters 432*a* to 432*g*.

With this configuration, even in the configuration including the plurality of noise microphones 420*a* to 420*g*, control speakers 440*a* and 440*b*, and error microphones 450*a* and 450*b*, and yet even in cases where many noise sources are present and noises come from various directions as in the cabin of aircraft 100, as described above, it is possible to effectively reduce the noises over a wide frequency band, from lower to higher frequencies.

EXAMPLE

The noise reducing effect of the Example of the noise reduction device according to the embodiment will be described together with Comparative Examples, as follows.

Figure 8:
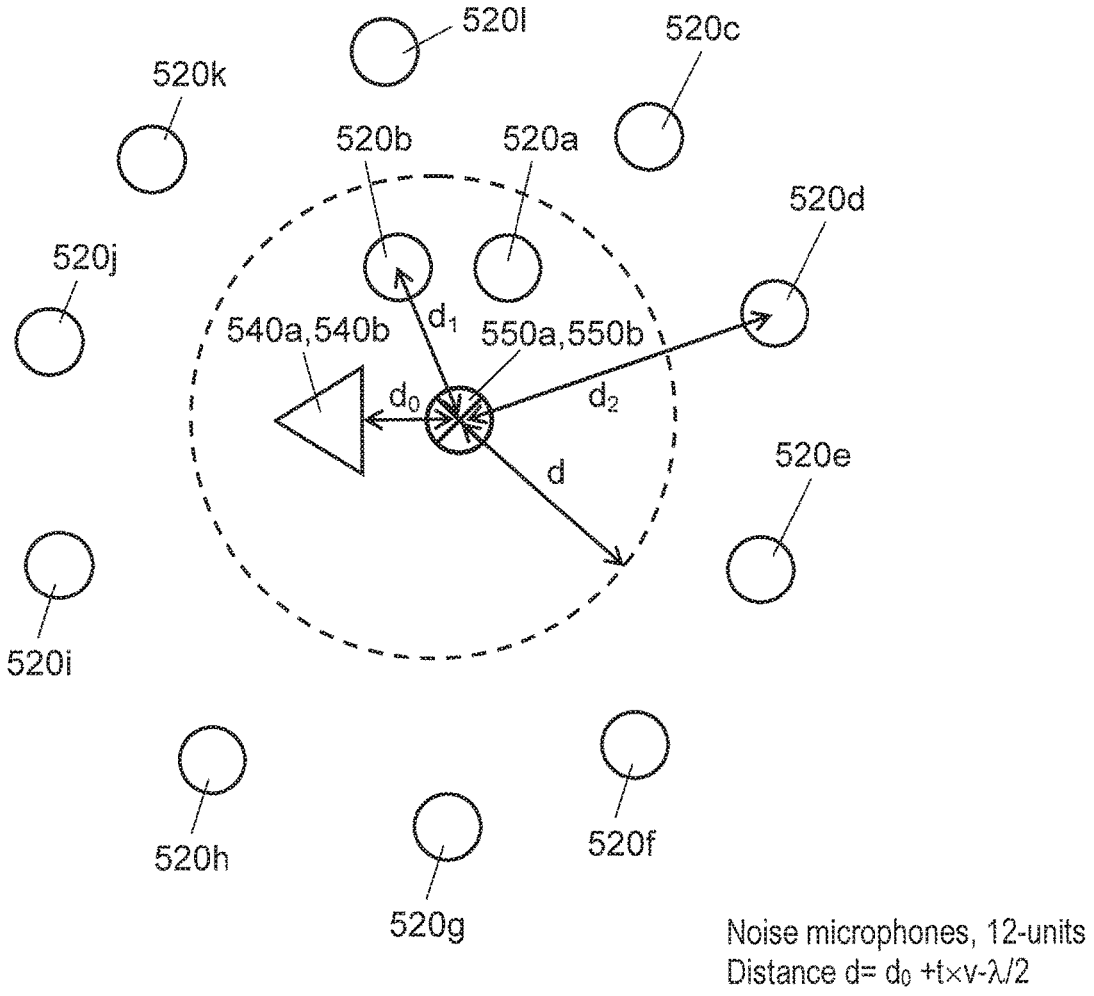
FIG. 8 is a view of an example of an arrangement of the noise microphones and the like in the noise reduction device according to the embodiment.

That is, in the Example, the noise reducing effect has been verified for the noise reduction device that includes twelve noise microphones 520*a* to 520*l*, two control speakers 540*a* and 540*b*, and two error microphones 550*a* and 550*b* serving as the control center, as shown in FIG. 8.

Here, as described above, distance "d0" is a distance from the control center (error microphones 550*a* and 550*b*) to control speakers 540*a* and 540*b*.

Noise microphones (first noise detecting unit) 520*a* and 520*b* are disposed on the inside of the dashed-line circle shown in FIG. 8 such that distance "d1" is shorter than distance "d" indicated by Relational Expression (1) described above, where distance "d1" is a distance from the control center (error microphones 550*a* and 550*b*) to the noise microphones.

On the other hand, noise microphones (second noise detecting unit) 520*c* to 520*l* are disposed on the outside of the dashed-line circle shown in FIG. 8 such that distance "d2" is longer than distance "d" indicated by the following Relational Expression (1) described above, where distance "d2" is a distance from the control center (error microphones 550*a* and 550*b*) to the noise microphones.

$$d=d0+t\times v-\lambda/2 \quad (1)$$

That is, in the Example, noise microphones 520*a* to 520*j* are disposed to satisfy Relational Expressions (2) and (3) (d1<d, d2>d) described above.

Next, Comparative Examples 1 and 2 will be described below which are compared with the Example to verify the noise reducing effect of the Example.

Comparative Example 1

Figure 9:
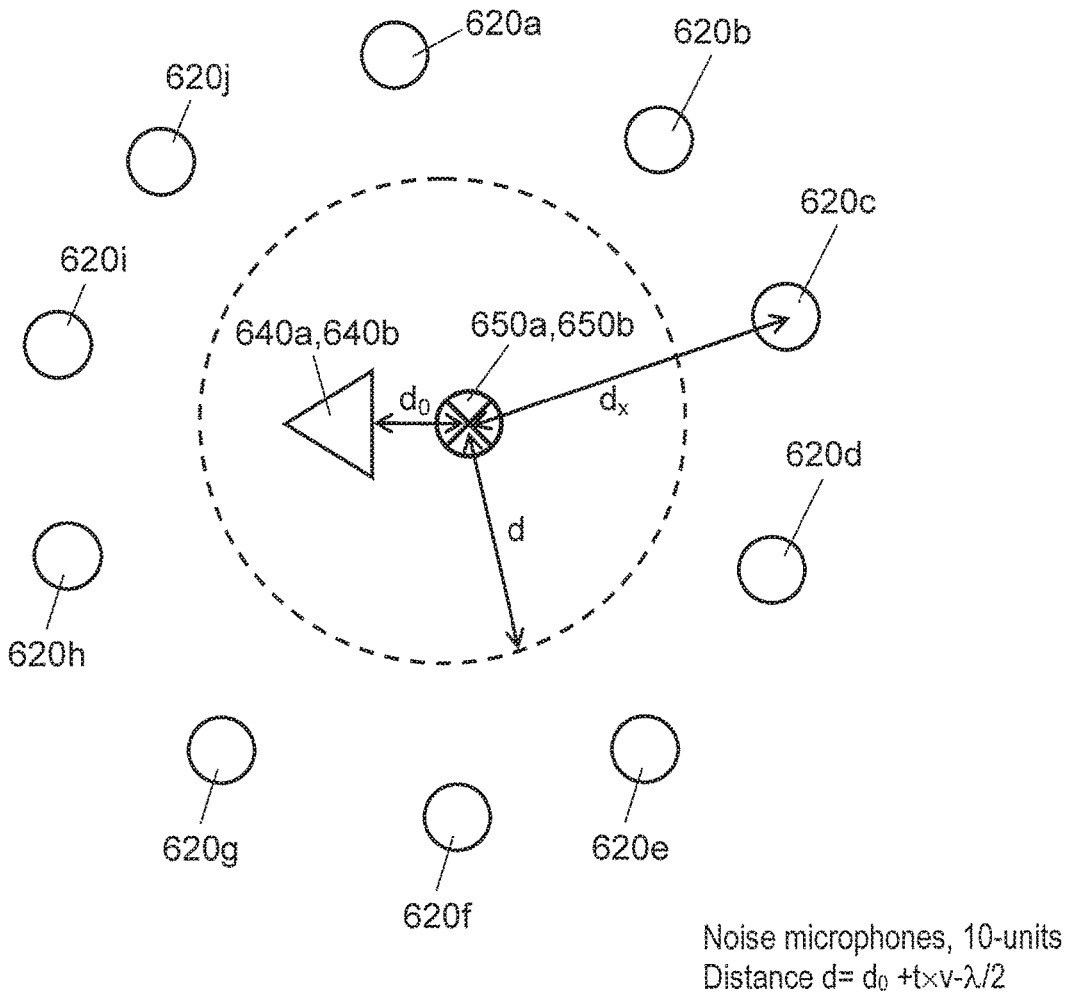
FIG. 9 is a view of an example of an arrangement of noise microphones and the like in a noise reduction device of a comparative example to the embodiment.

In the Comparative Example, the noise reducing effect of a comparative noise reduction device has been verified, with the device including ten noise microphones 620*a* to 620*j*, two control speakers 640*a* and 640*b*, and two error microphones 650*a* and 650*b* serving as the control center, as shown in FIG. 9.

Here, in the same way as described above, distance "d0" is a distance from the control center (error microphones 650*a* and 650*b*) to control speakers 640*a* and 640*b*.

In the Comparative Example, all of ten noise microphones 620*a* to 620*j* are disposed on the outside of the dashed-line circle shown in FIG. 9 such that distance "dx" is longer than distance "d" indicated by the following Relational Expression (1) described above, where distance "dx" is a distance from the control center (error microphones 650*a* and 650*b*) to the noise microphones.

$$d=d0+t\times v-\lambda/2 \quad (1)$$

That is, in the Comparative Example, noise microphones 620*a* to 620*j* are disposed to satisfy the relation of dx>d.

Comparative Example 2

Figure 10:
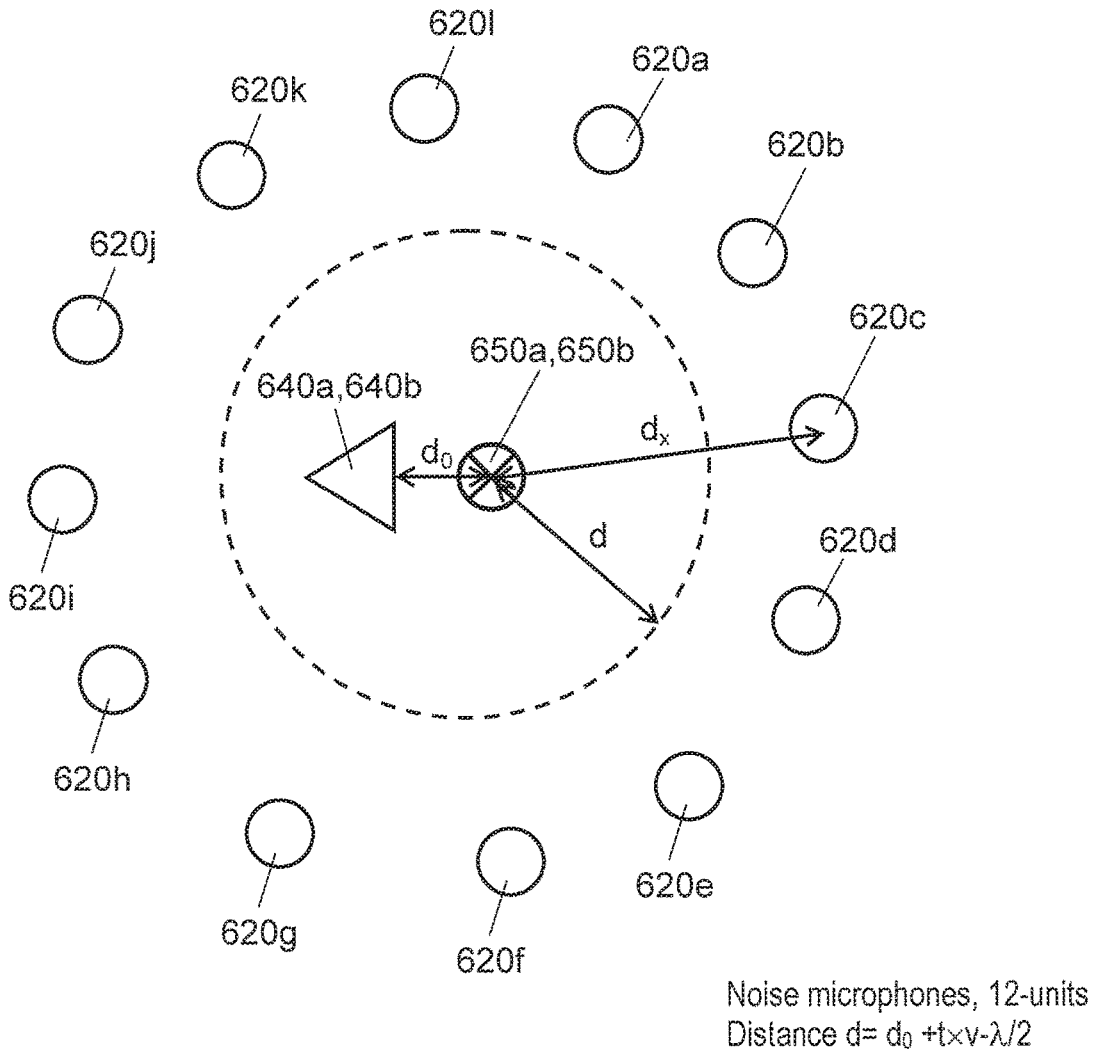
FIG. 10 is a view of an example of an arrangement of the noise microphones and the like in a noise reduction device of a comparative example to the embodiment shown in FIG. 8.

In the Comparative Example, the noise reducing effect of a comparative noise reduction device has been verified, with the device including twelve noise microphones 620*a* to 620*l*, two control speakers 640*a* and 640*b*, and two error microphones 650*a* and 650*b* serving as the control center, as shown in FIG. 10.

Here, in the same way as described above, distance "d0" is a distance from the control center (error microphones 650*a* and 650*b*) to control speakers 640*a* and 640*b*.

In the Comparative Example, all of twelve noise microphones 620*a* to 620*l* are disposed on the outside of the dashed-line circle shown in FIG. 10 such that distance "dx" is longer than distance "d" indicated by the following Relational Expression (1) described above, where distance "dx" is a distance from the control center (error microphones 650*a* and 650*b*) to the noise microphones.

$$d=d0+t\times v-\lambda/2 \quad (1)$$

That is, in the Comparative Example as well, noise microphones 620*a* to 620*j* are disposed to satisfy the relation of dx>d, in the same way as for Comparative Example 1 described above.

[Verification Result of Noise Reducing Effects of Configurations of Example and Comparative Examples 1, 2]

Figure 11:
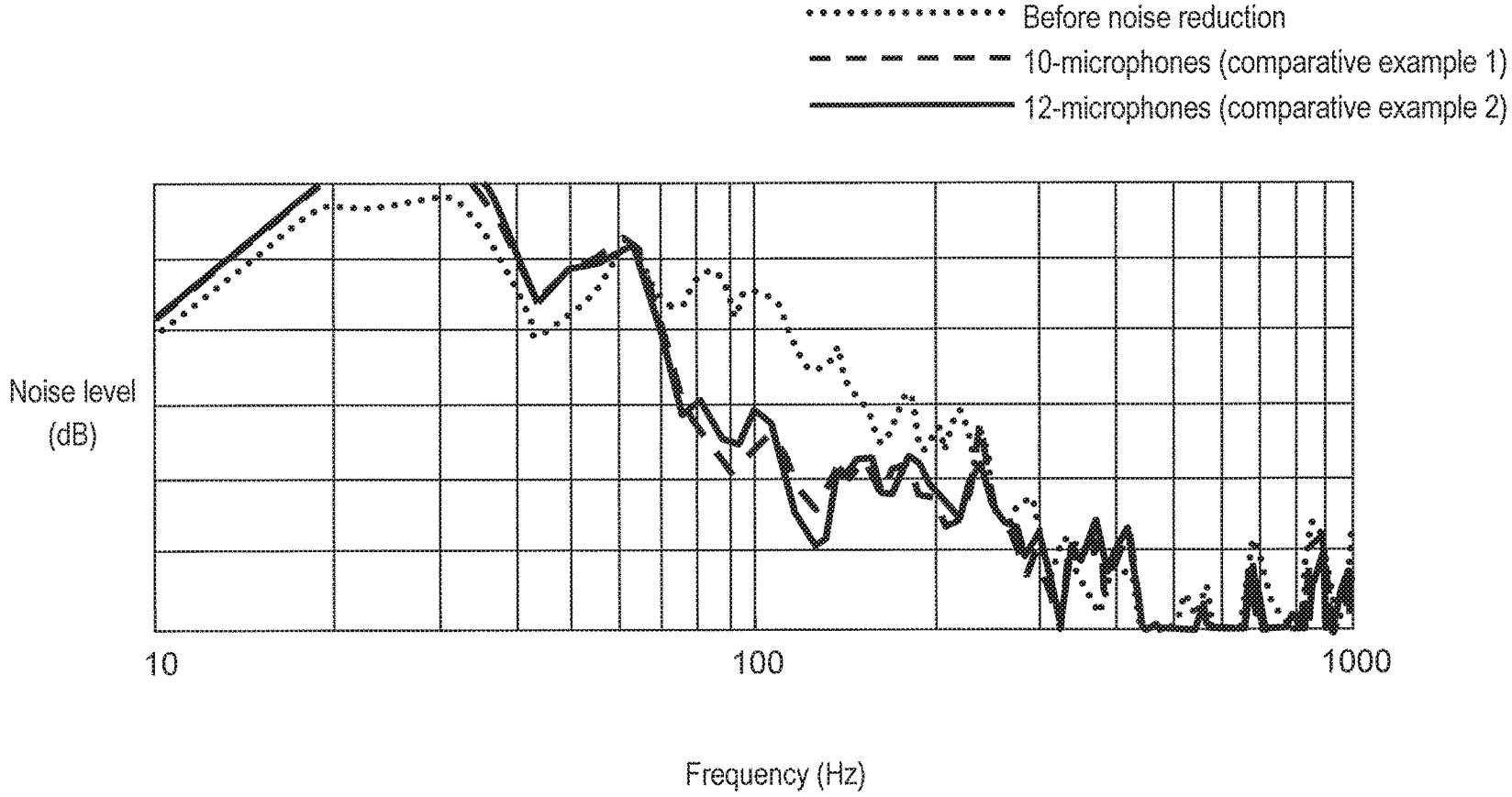
FIG. 11 is a graph illustrating a result of verification of a noise reduction effect of the noise reduction devices of the comparative examples shown in FIGS. 9 and 10.

First, the result is described of verification of the noise reducing effects of the configurations of Comparative Examples 1 and 2, by using the graph shown in FIG. 11.

For the configuration of Comparative Example 1 using ten noise microphones 620*a* to 620*j*, the result shows that the noise reducing effect appears in a frequency band not lower than a frequency of 70 Hz, with the major effect appearing in a frequency band from 70 to 300 Hz.

On the other hand, for the configuration of Comparative Example 2 using twelve noise microphones 620*a* to 620*l*, the result shows that the noise reducing effect appears in a frequency band not lower than a frequency of 70 Hz, and that the approximately equivalent effect to that for Comparative Example 1 describe above is achieved in a frequency band from 70 to 300 Hz.

Figure 12:
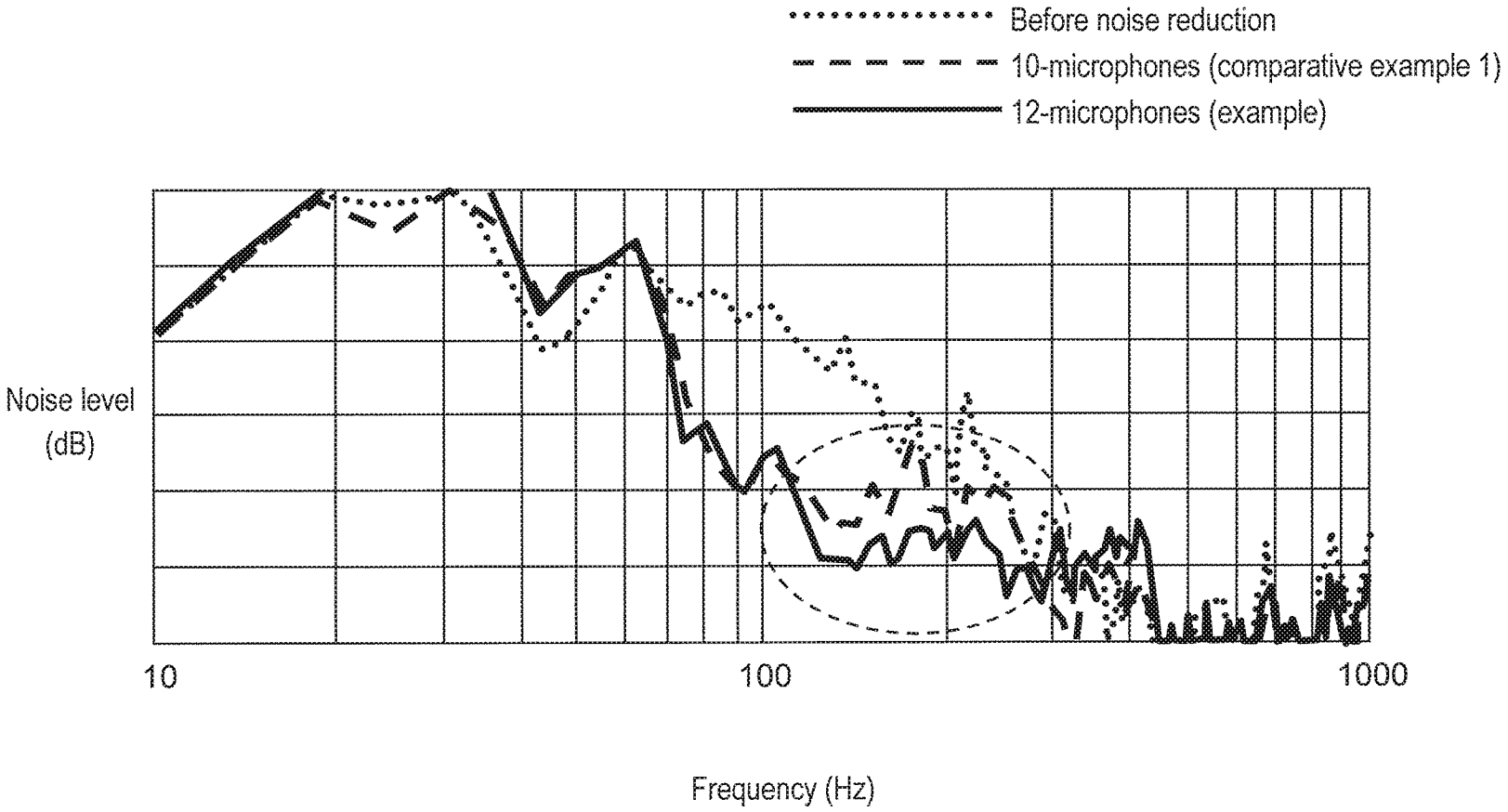
FIG. 12 is a graph illustrating a result of verification of noise reduction effects of the noise reduction device according to the example shown in FIG. 8 and the noise reduction device of the comparative example shown in FIG. 9.

Next, the result is described of verification of the noise reducing effects of the configurations of the Example and Comparative Example 1, by using the graph shown in FIG. 12.

That is, by comparing the result for the configuration of the Example to the result for the configuration of Comparative Example 1 using ten noise microphones 620*a* to 620*j*, it can be seen that the noise reducing effect appears for both configurations in a frequency band from 70 to 300 Hz.

However, particularly in a frequency band from 100 to 300 Hz, the Example is found to be greater in degree of noise reducing effect than Comparative Example 1.

The following factor of the Example is considered to be responsible for this. That is, not all of noise microphones 520*a* to 520*l* are disposed at the positions more distant than distance "d" from the control center, and some of them, i.e. noise microphones 520*a* and 520*b*, are disposed at the positions closer than distance "d" to the control center.

That is to say, in the configuration of the Example, with reference to distance "d" from the control center, two noise microphones 520*a* and 520*b* are disposed at the positions closer than distance "d" to the control center, while more than two noise microphones 520*c* to 520*l* are disposed at the positions more distant than distance "d" from the control center.

With this configuration, it is considered that the correlation can be held in a high level between the noise detected by noise microphones 520*a* to 520*l* and the noise actually reaching the proximity of user's ears, with the causality being satisfied for the noise reduction control. Therefore, even in cases where many noise sources are present and noises come from various directions, as in the cabin of an aircraft, it is possible to effectively reduce the noises over a wide frequency band, from lower to higher frequencies.

Figure 13:
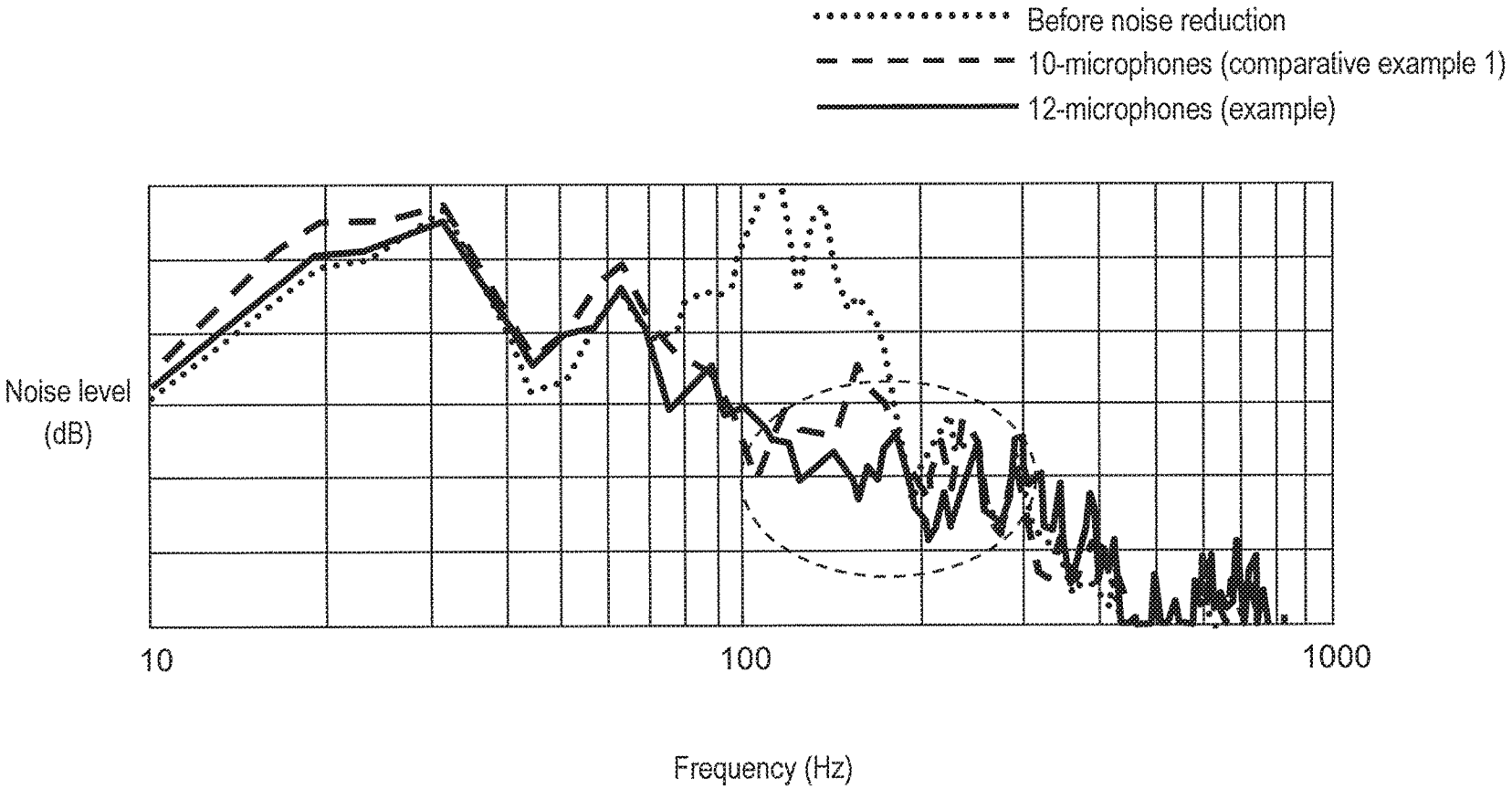
FIG. 13 is a graph illustrating a result of verification of the noise reduction effects of the noise reduction device according to the example shown in FIG. 8 and the noise reduction device of the comparative example shown in FIG. 9.

Likewise, from the graph shown in FIG. 13 of the verification conducted for the case where various conditions (the positions of the noise sources, the presence or absence of the enclosure such as a shell) are changed from those for the graph shown in FIG. 12, the Example is found to be greater in degree of noise reducing effect than Comparative Example 1 in a frequency band from 100 to 300 Hz.

From the results described above, it can be seen that the configuration according to the embodiment described above provides the more effective noise reduction, compared to the conventional configurations.

As indicated by the results shown in FIGS. 12 and 13, the noise microphones disposed at positions closer than distance "d" are effective in reducing the noise at frequencies not higher than 300 Hz. Therefore, the control upper-limit frequency of the noise microphones at the positions closer than distance "d" is preferably 300 Hz. In contrast, the control upper-limit frequency of the noise microphones (i.e. the control upper-limit frequency of the noise reduction device) at more distant positions than distance "d" is preferably not smaller than 300 Hz.

Other Exemplary Embodiments

As described above, the first embodiment has been described to exemplify the technology disclosed in the present application. However, the technology is not limited to the embodiment, and is also applicable to embodiments that are subjected, as appropriate, to various changes and modifications, replacements, additions, omissions, and the like. Moreover, the technology disclosed herein also allows another embodiment which is configured by combining the appropriate constituent elements in the first embodiment described above.

Given these factors, other embodiments will be exemplified hereinafter.

(A)

In the embodiment described above, the description has been made using the example in which the arrangement of, noise microphone 420*a* and noise microphones 420*b* to 420*g* is determined with reference of distance "d" that is set based on a wavelength of "λ" corresponding to control upper-limit frequency "f" of noise microphones 420*a* to 420*g*, and the like. However, the present disclosure is not limited to this.

Figure 14:
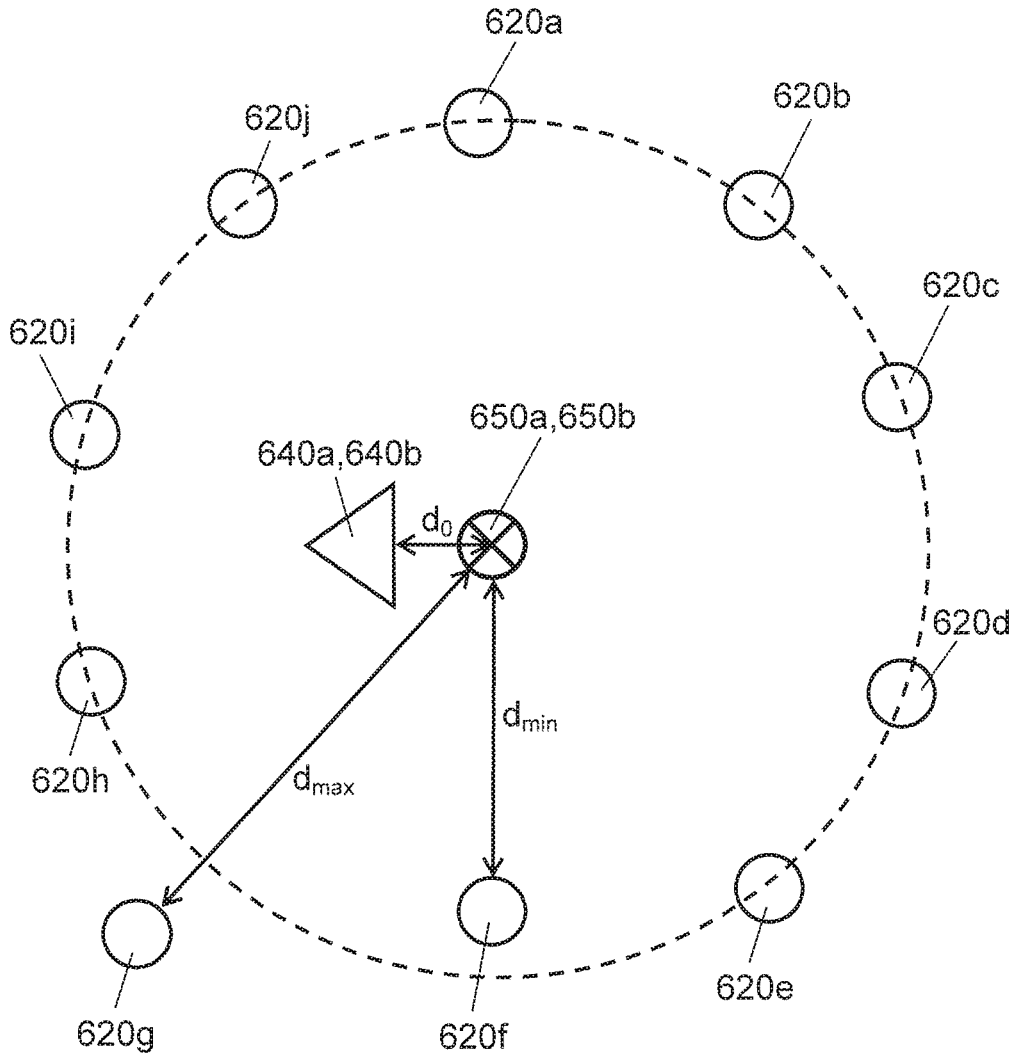
FIG. 14 is a view of an example of an arrangement of noise microphones and the like in a noise reduction device according to another embodiment of the present disclosure.

For example, as shown in FIG. 14, the noise reducing effect is described for the case where ten noise microphones 620*a* to 620*j* are disposed such that their distances from error microphones 650*a* and 650*b* serving as the control center are approximately equal to each other.

In general, in cases where the noise microphones are disposed only at close positions to the control center, causality is not satisfied, resulting in only a little effect on the degree to which low-frequency (e.g. not higher than 300 Hz) sounds are reduced a little.

In contrast, in cases where the noise microphones are disposed only at distant positions from the control center, the causality is satisfied, allowing a noise reducing effect over a wide frequency band. Unfortunately, such a configuration causes a decrease in correlation between the noise detected by the noise microphones and the noise reaching the control center, resulting in a problem, that is, a decrease in sound volume by which the noise is reduced.

In order to enhance the correlation, the noise microphones are preferably disposed closer to the control center within a range of distance "da" indicated by Relational Expression (4). On the other hand, however, in order to satisfy the causality, distance "db" indicated by Relational Expression (5) needs to be satisfied. Accordingly, in the case where many noise microphones are disposed, the arrangement in which the distances of the noise microphones are approximately equal to each other within a range between distances "da" and "db," can enhance the noise reducing effect more greatly. This is because a favorable interaction between the effect of satisfying the causality and the effect of enhancing the correlation.

Note that, "λ" is a wavelength corresponding to control upper-limit frequency "f" of noise microphones 620*a* to 620*j*, "t" is a control delay time in the control speakers, and "v" is a sound speed.

That is, such approximately equal distances in the arrangement allows Relational Expression (6) to be satisfied, as shown in FIG. 14, where distance "dmax" is the distance of noise microphone 620*g* disposed at the most distant position from the control center, and distance "dmin" is the distance of noise microphone 620*f* disposed at the closest position to the control center. That is, $$da=d0+t\times v-\lambda/2, \quad (4)$$

$$db=d0+t\times v, \quad (5)$$

$$d\max\times d\min<\lambda/2. \quad (6)$$

Note that, in a case where the control delay time of the speakers is not known, Relational Expressions (4) and (5) cannot be determined. Even with such a case, however, a number of noise microphones can be disposed to have approximately equal distances (within the range indicated by Relational Expression (6)), thereby effectively reducing noises with the smaller number of the microphones than is usually expected.

Here, if applying the configuration of this embodiment to the aforementioned configuration of the embodiment shown in FIG. 4, the aforementioned configuration can be seen to correspond to the arrangement in which noise microphones 420*b* to 420*g*, excluding noise microphones 420*a*, are disposed at the distances approximately equal to each other from either error microphones 450*a* or 450*b* serving as the control center.

Figure 15:
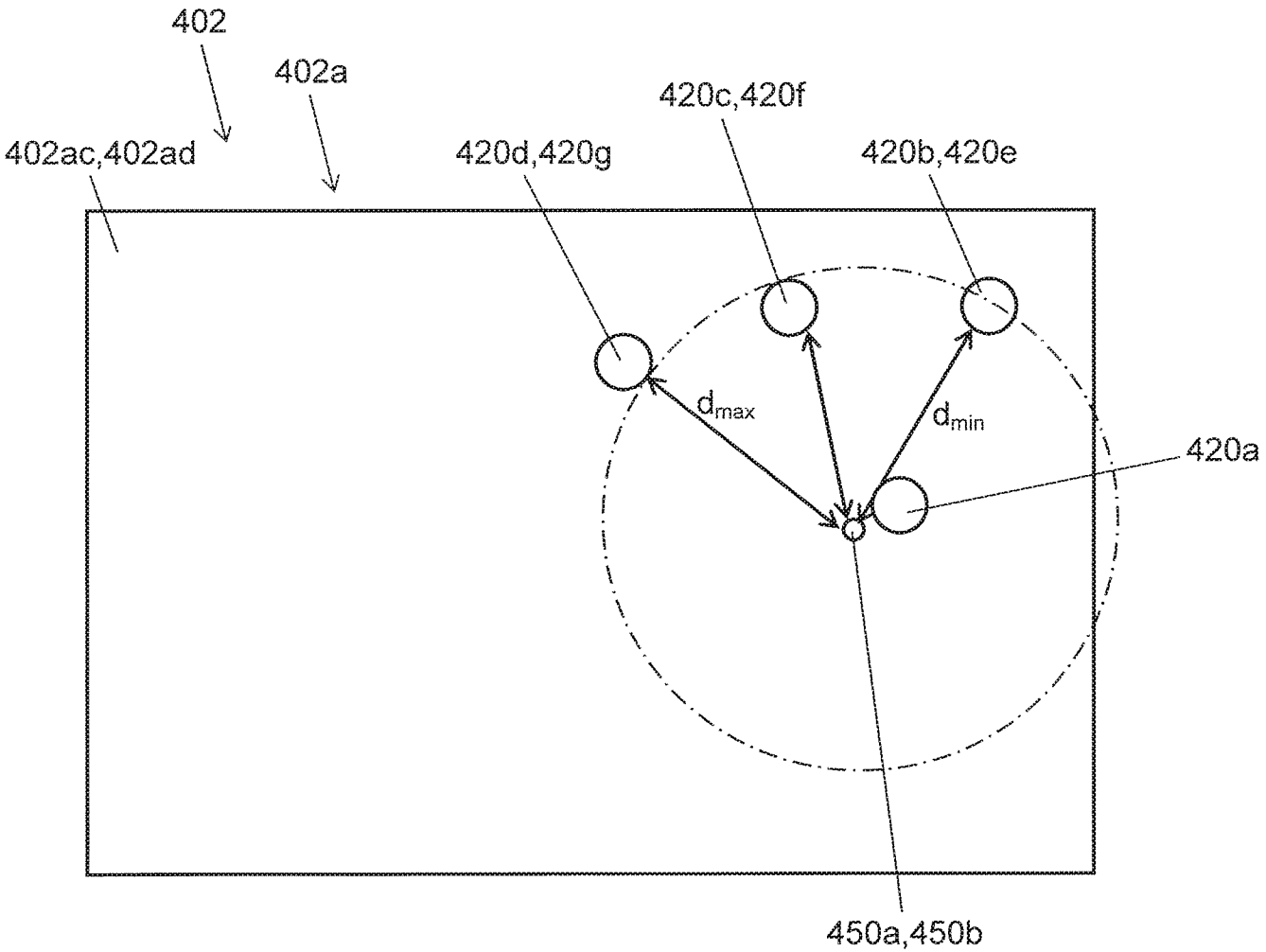
FIG. 15 is a view of an example of an arrangement of noise microphones and the like in a noise reduction device according to further another embodiment of the disclosure.

FIG. 15 is a side-elevational view of FIG. 4, showing an example of the arrangement in which noise microphones 420*b* to 420*d* are disposed at approximately equal distances from error microphones 450*a*, and noise microphones 420*e* to 420*g* are disposed at approximately equal distances from error microphones 450*b*.

In this way, when a plurality of the control centers is present, it is only required for the noise microphones to be disposed at approximately equal distances to each other from the respective control centers; therefore, the arrangement of the noise microphones is not limited to that described above.

For example, the midpoint between error microphones 450*a* and error microphones 450*b* may be regarded as a control center from which the distances of the noise microphones are determined to be approximately equal to each other. Alternatively, only either control center 450*a* or 450*b* may be regarded as the control center.

Figure 16:
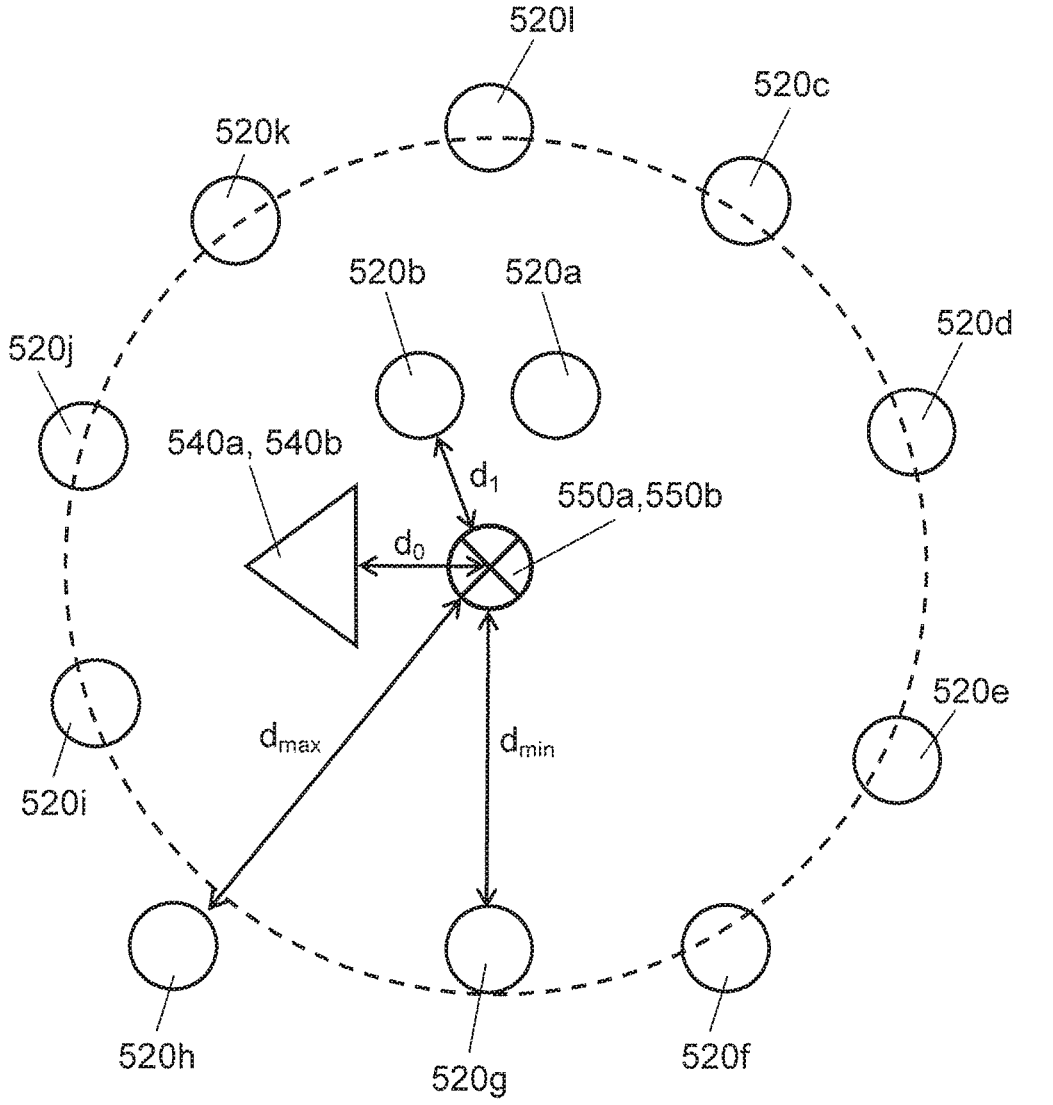
FIG. 16 is a view of an example of an arrangement of noise microphones and the like in a noise reduction device according to still another embodiment of the disclosure.

Moreover, as shown in FIG. 16, in addition to the many noise microphones disposed at the approximately equal distances in the same way as for the embodiment described above, additional noise microphones may be disposed at distances closer than distance "dmin" to the control center. The additional noise microphones are smaller in number than the many noise microphones.

With this configuration, even in cases where many noise sources are present and noises come from various directions due to reverberations and the like, as in the cabin of an aircraft, it is possible to effectively reduce the noises over a wide frequency band, from lower to higher frequencies. Note that, in the configurations shown in FIGS. 4 and 15, noise microphone 420*a* corresponds to the microphone disposed at the closest position.

(B)

In the other embodiment (A) described above, the description has been made regarding the example in which noise microphones 420*b* to 420*g* are disposed in side walls 402*ac* and 402*ad* of shell 402*a* installed in the aircraft such that the distances of the microphones are approximately equal to each other from the control center. However, the present disclosure is not limited to this.

Figure 17:
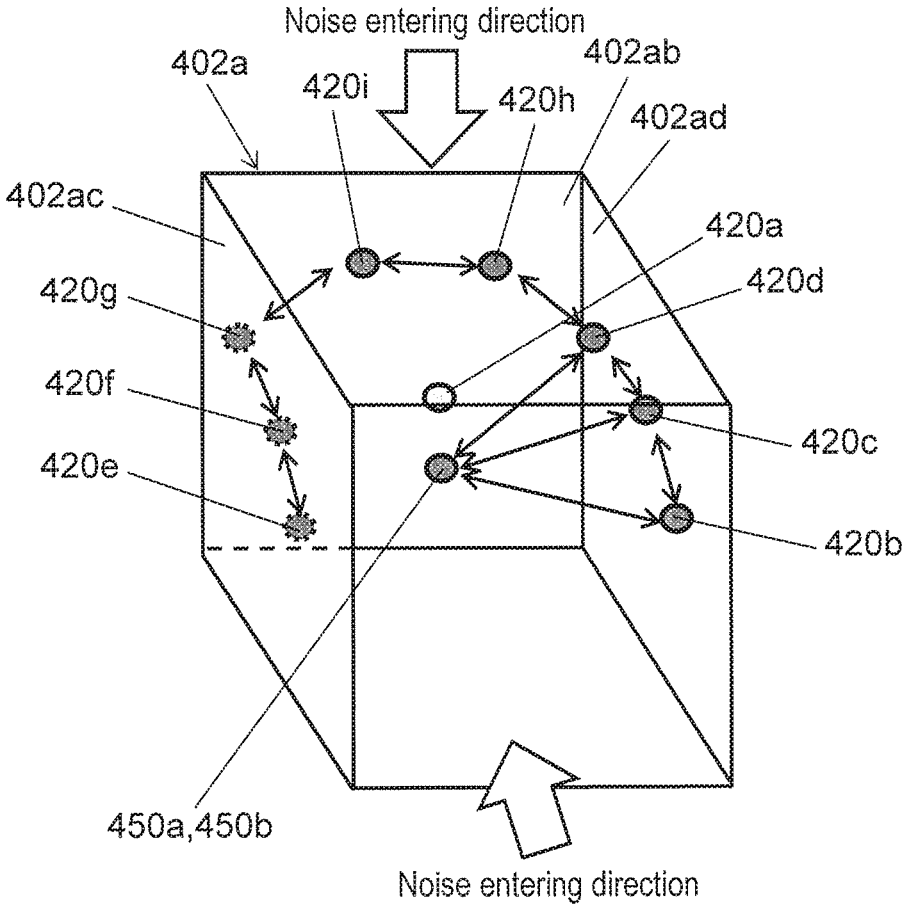
FIG. 17 is a view of an example of an arrangement of noise microphones and the like in a noise reduction device according to yet another embodiment of the disclosure.

FIG. 17 shows the configuration of a shell devoid of front wall 402*aa*, in comparison with the configuration shown in FIG. 4, illustrating the case where major noises come from opened directions, i.e. the front and top directions. For example, in addition to noise microphones 420*b* to 420*g* disposed in side walls 402*ac* and 402*ad* of shell 402*a*, noise microphones 420*h* and 420*i* may be disposed in back wall 402*ab* of shell 402*a*, as shown in FIG. 17.

Even in this case, the noise microphones may be disposed in such a manner that: Noise microphones 420*b* to 420*i* are disposed such that the distances from the control center are approximately equal to each other, and noise microphones 420*b* to 420*i* are disposed at spacing-intervals approximately equal to each other, with each of the spacing-intervals being a distance between adjacent two of the noise microphones. This configuration allows the same noise reducing effect as that described above, on the inside of shell 402*a* where the noise-entering directions are restricted to some extent.

Figure 18:
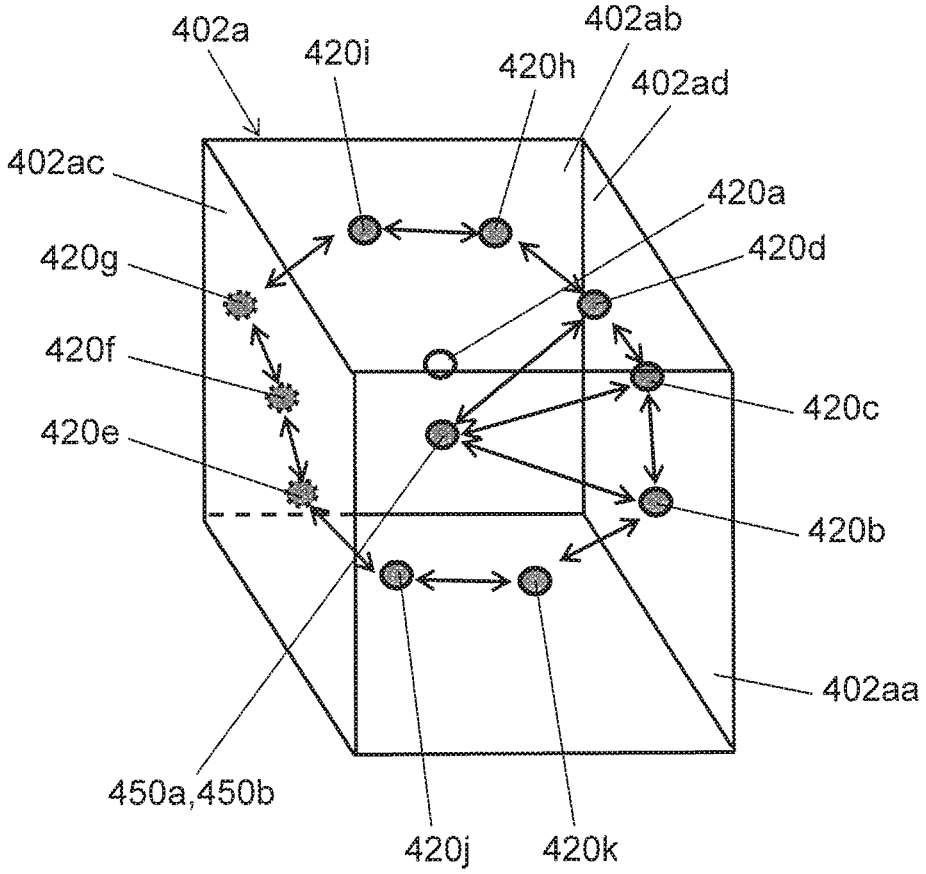
FIG. 18 is a view of an example of an arrangement of noise microphones and the like in a noise reduction device according to another embodiment of the disclosure.

Moreover, FIG. 18 shows an example in which front wall 402*aa* is present in addition to the configuration shown in FIG. 17. In this case, noise microphones 420*j* and 420*k* may be additionally disposed in front wall 402*aa* of shell 402*a*.

Even in this case, the noise microphones may be disposed in such a manner that: Noise microphones 420*b* to 420*k* are disposed such that the distances from the control center are approximately equal to each other, and noise microphones 420*b* to 420*k* are disposed at spacing-intervals approximately equal to each other, with each of the spacing-intervals being a distance between adjacent two of the noise microphones. This configuration allows the same noise reducing effect as that described above, on the inside of shell 402*a* where the noise-entering directions are restricted to some extent.

Figure 19:
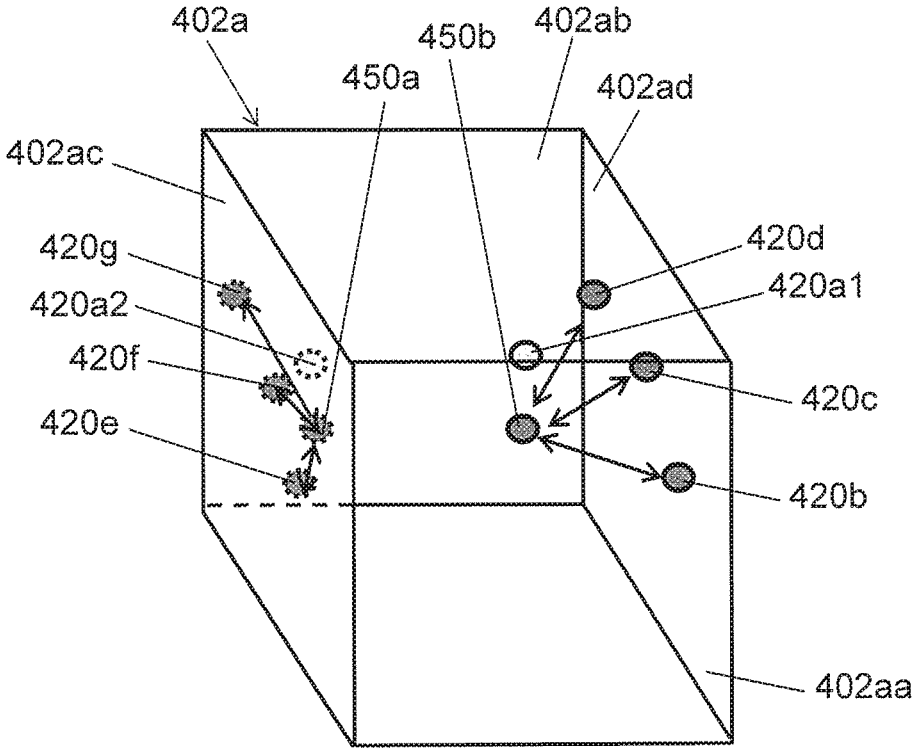
FIG. 19 is a view of an example of an arrangement of noise microphones and the like in a noise reduction device according to further another embodiment of the disclosure.

Furthermore, as shown in FIG. 19, a plurality of error microphones 450*a* and 450*b* may be disposed, and noise microphones 420*a*1 and 420*a*2 for short range use may be disposed in the proximity of error microphones 450*a* and 450*b*, respectively.

Even in this case, the noise microphones may be disposed in such a manner that: Noise microphones 420*b* to 420*d* are disposed such that the distances from the control center (error microphones 450*b*) are approximately equal to each other; noise microphones 420*e* to 420*g* are disposed such that the distances from the control center (error microphones 450*a*) are approximately equal to each other; noise microphones 420*b* to 420*d* are disposed at spacing-intervals approximately equal to each other, with each of the spacing-intervals being a distance between adjacent two of the noise microphones; and noise microphones 420*e* to 420*g* are disposed at spacing-intervals approximately equal to each other, with each of the spacing-intervals being a distance between adjacent two of the noise microphones. This configuration allows the same noise reducing effect as that described above.

Figure 20A:
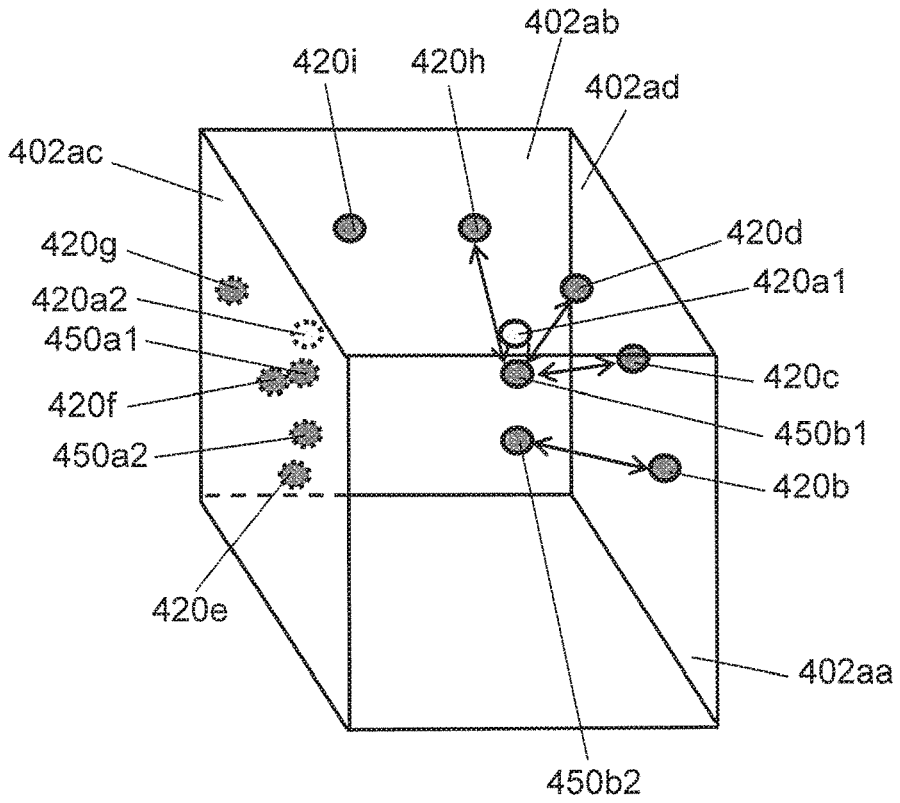
FIG. 20A is a perspective view of an example of an arrangement of noise microphones and the like in a noise reduction device according to still another embodiment of the disclosure.
Figure 20B:
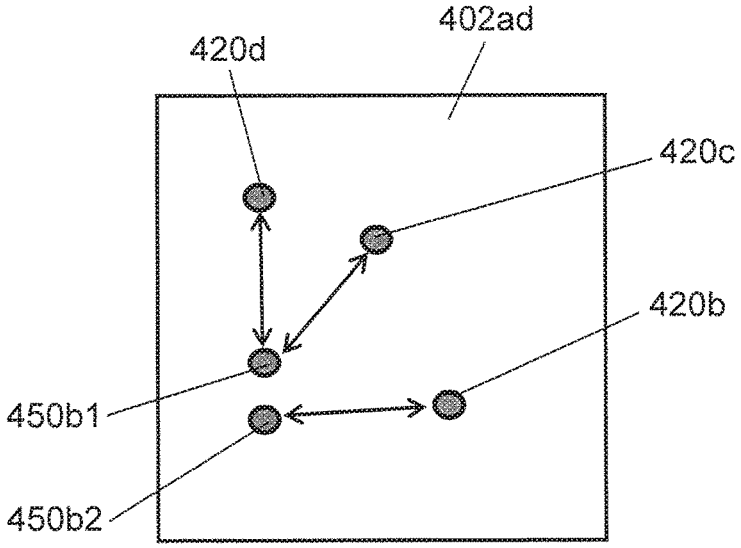
FIG. 20B is a side-elevational view of the example of the arrangement of the noise microphones and the like in the noise reduction device according to the still another embodiment of the disclosure.

Moreover, as shown in FIGS. 20A and 20B, the configuration may be such that error microphones 450*al* and 450*a*2 are disposed on the side wall 402*ac* side and that error microphones 450*b*1 and 450*b*2 are disposed on the side wall 402*ad* side.

In this case, in corresponding with these error microphones, noise microphones are only required to be disposed in such a manner that: Concerning error microphones 450*al* and 450*a*2 on the side wall 402*ac* side, noise microphones 420*e* to 420*g* are disposed such that distances are approximately equal to each other, with each of the distances being measured between the noise microphone and either error microphones 450*al* or 450*a*2 whichever is closer to the noise microphone. In addition, as shown in FIG. 20B, concerning error microphones 450*b*1 and 450*b*2 on the side wall 402*ad* side, noise microphones 420*b* to 420*d* are disposed such that distances are approximately equal to each other, with each of the distances being measured between the noise microphone and either error microphones 450*b*1 or 450*b*2 whichever is closer to the noise microphone.

Alternatively, for these error microphones, the noise microphones may be disposed in such a manner that: On the side wall 402*ac* side, either error microphones 450*al* or 450*a*2 is regarded as a reference, and the noise microphones are disposed such that the distances from the reference to the noise microphones are approximately equal to each other. In addition, on the side wall 402*ad* side, either error microphones 450*b*1 or 450*b*2 is regarded as a reference, and the noise microphones are disposed such that the distances from the reference to the noise microphones are approximately equal to each other.

Figure 21:
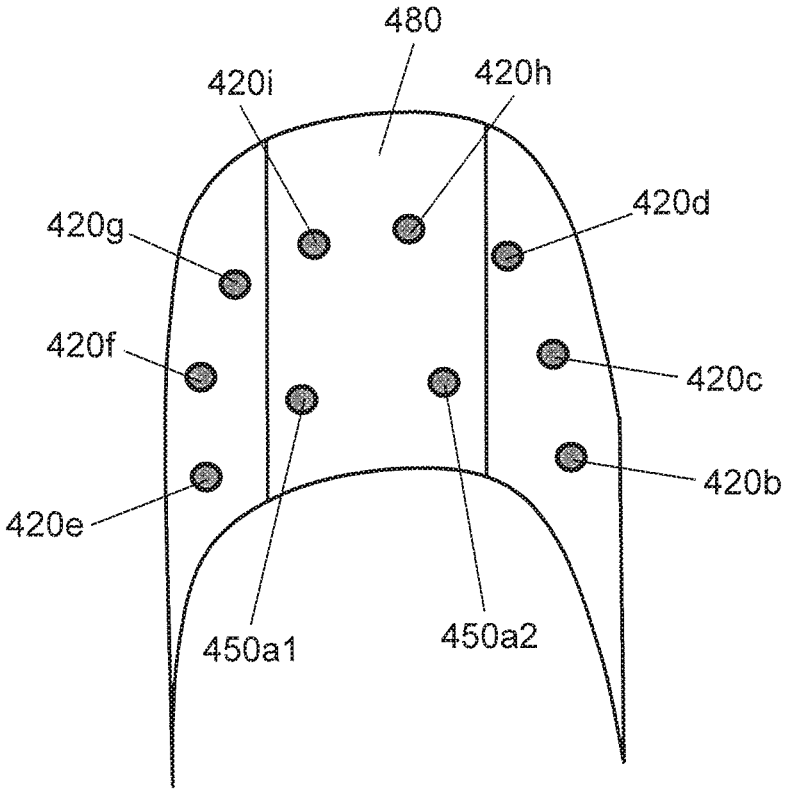
FIG. 21 is a view of an example of an arrangement of noise microphones and the like in a noise reduction device according to yet another embodiment of the disclosure.

Moreover, as shown in FIG. 21, in the case where shell 480 has a hood-like shape, noise microphones 420*b* to 420*i* may be disposed such that distances from either error microphones 450*al* or 450*a*2 to the noise microphones are approximately equal to each other.

Note that, in this case, noise microphones 420*b* to 420*i* are preferably disposed at spacing-intervals approximately equal to each other, with each of the spacing-intervals being a distance between adjacent two of the noise microphones.

This configuration allows the noise reducing effect on the inside of shell 480 described above.

(C)

In the above embodiments, the descriptions have been made using the example in which the noise reducing control is performed provided that the influence of the control sounds on noise microphones 420*a* to 420*g* (particularly, noise microphone 420*a*) can be neglected, with the control sound having the opposite phase to the noise and being emitted from control speakers 440*a* and 440*b*. However, the present disclosure is not limited to this.

Figure 22:
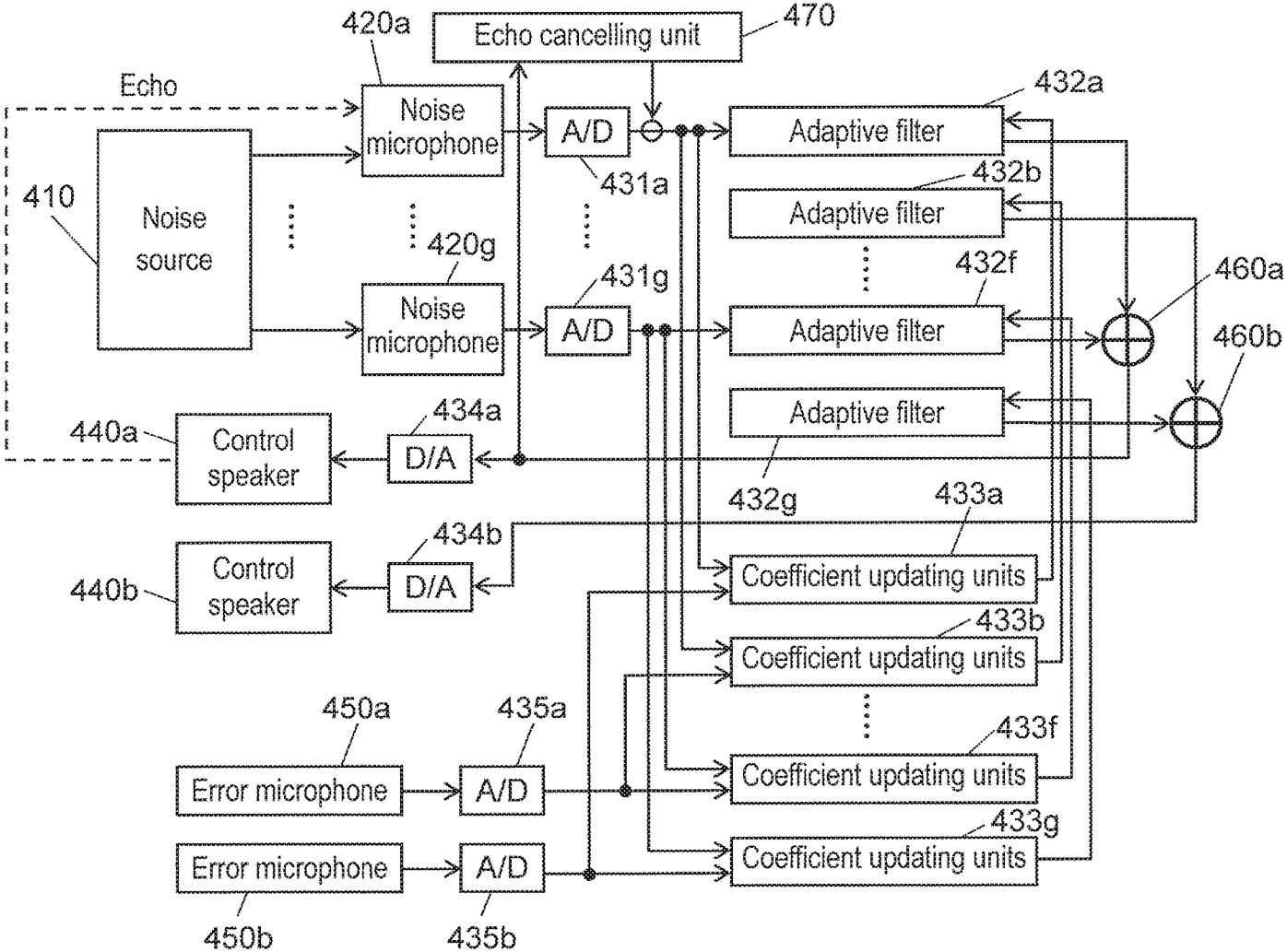
FIG. 22 is a block diagram of a configuration of a noise reduction device according to another embodiment of the disclosure.

For example, a phenomenon concerned here is that noise microphones 420*a* to 420*g* will detect the control sound having the opposite phase to the noise, with the control sound being emitted from control speakers 440*a* and 440*b*. This may prevent the noise microphones from correctly detecting the actual noise. To prevent such an incorrect detection, as shown in FIG. 22, echo cancelling unit 470 may be disposed to cancel the control sound detected by noise microphones 420*a* to 420*g*.

Echo cancelling unit 470 performs echo cancelling processing in such a manner that: As shown in FIG. 22, the echo cancelling unit receives an echo signal of the control sound emitted from control speaker 440*a*. Then, in accordance with the echo signal, the echo cancelling unit cancels part of the output from noise microphone 420*a*, with the part corresponding to the echo signal.

Specifically, echo cancelling unit 470 is disposed and designated for noise microphones 420*a* for a lower frequency range. Moreover, in the echo cancelling, echo cancelling unit 470 measures a transfer function, in advance, which can express the characteristics of an involved system until the output from control speaker 440*a* is detected by noise microphone 420*a*. The echo cancelling unit approximates such a transfer function by means of a finite impulse response (FIR) filter. Then, the echo cancelling unit passes the output of control speaker 440*a* through the FIR filter, thereby subjecting the output to the transfer function. The resulting output signal is then subtracted from the input from noise microphone 420*a*, thereby completing the echo cancelling processing.

With this configuration, it is possible to cancel the sound, which corresponds to the control sound, from the noise detected by noise microphone 420*a* that is disposed at a position close to the control speaker 440*a*. Therefore, even in the case where noise microphone 420*a* is disposed at such a position close to control speaker 440*a*, the noise microphone can correctly detect the noise without being subjected to the influence of the control sound.

Note that, in the configuration shown in FIG. 22, echo cancelling unit 470 is disposed at the part corresponding to both control speaker 440*a* and noise microphone 420*a*. However, the echo cancelling unit may be disposed at a part corresponding to all of the noise microphones which are disposed at positions close to the control center (error microphones 450*a* and 450*b*).

Alternatively, the echo cancelling unit may be disposed at a part corresponding to all of the noise microphones, independently of the distances from the control center.

(D)

In the embodiments, the descriptions have been made using the example in which seven noise microphones 420*a* to 420*g* commonly employ the wide-band microphones, without distinguishing their frequency ranges between low and high frequencies. However, the present disclosure is not limited to this.

For example, a low pass filter (LPF) passing sounds of only lower frequencies may be disposed in a pre-stage part of the coefficient updating unit that corresponds to the noise microphone disposed at a position closer than distance "d" describe above. In addition, a high pass filter (HPF) passing sounds of only higher frequencies may be disposed in a pre-stage part of the coefficient updating unit that corresponds to the noise microphone disposed at a position more distant than distance "d" describe above.

With this configuration, the noise microphones disposed at the positions closer than distance "d" can be used as ones for lower frequencies, while the noise microphones disposed at the positions more distant than distance "d" can be used as ones for higher frequencies.

(E)

In the embodiments described above, the descriptions have been made using the example in which the noise detecting units for detecting the noise are noise microphones 420*a* to 420*g*, etc. However, the present disclosure is not limited to this.

For example, vibration sensors and the like may be used instead of these microphones.

(F)

In the embodiments described above, the descriptions have been made using the example in which the noise reduction device according to the present disclosure is installed in the cabin of aircraft 100. However, the present disclosure is not limited to this.

The installation site of the noise reduction device is not limited to the cabin of an aircraft. For example, the noise reduction device may be installed in the cockpit of the aircraft, for reducing a burden on ears of a pilot. Alternatively, the noise reduction device may be installed in vehicles other than aircraft, including helicopters, trains, and buses. Moreover, besides movable bodies such as vehicles, the noise reduction device may be installed in other places including buildings located in the neighborhood of, such as, a construction site or a club with live music which emits a noise.

Note that, because the aforementioned embodiments are used only for the exemplification of the technology according to the present disclosure, it is to be understood that various changes and modifications, replacements, additions, omissions, and the like may be made to the embodiments without departing from the scope of the appended claims or the scope of their equivalents.

The noise reduction device according to the present disclosure provides the advantage of effectively reducing noises over a wide frequency band, from lower to higher frequencies, even in cases where many noise sources are present and/or noises come from various directions due to strong reverberations, such as in seats in aircraft cabins. Therefore, the noise reduction device is widely applicable to noise reduction devices installed at various locations.

(G)

Figure 23A:
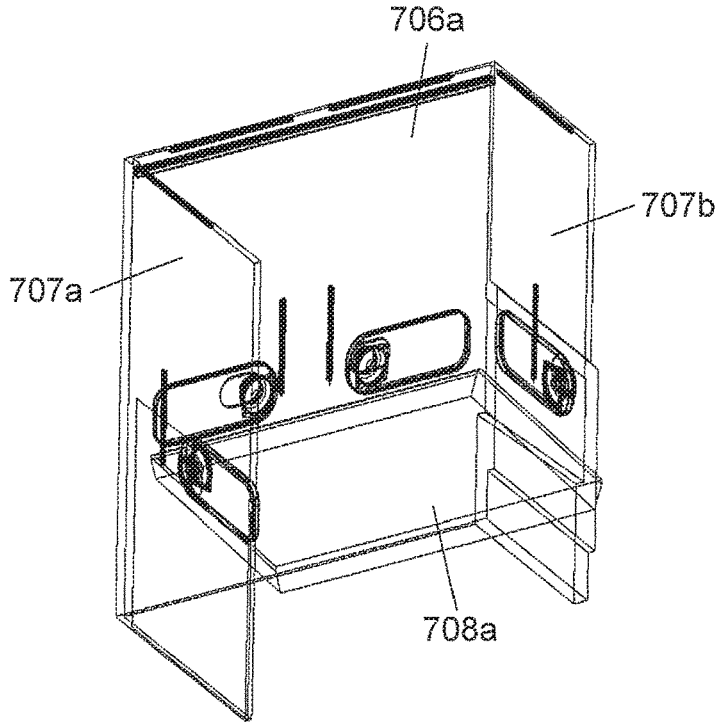
FIG. 23A is a view of an example of further another embodiment according to the disclosure, showing a different arrangement from that of FIG. 4.
Figure 23B:
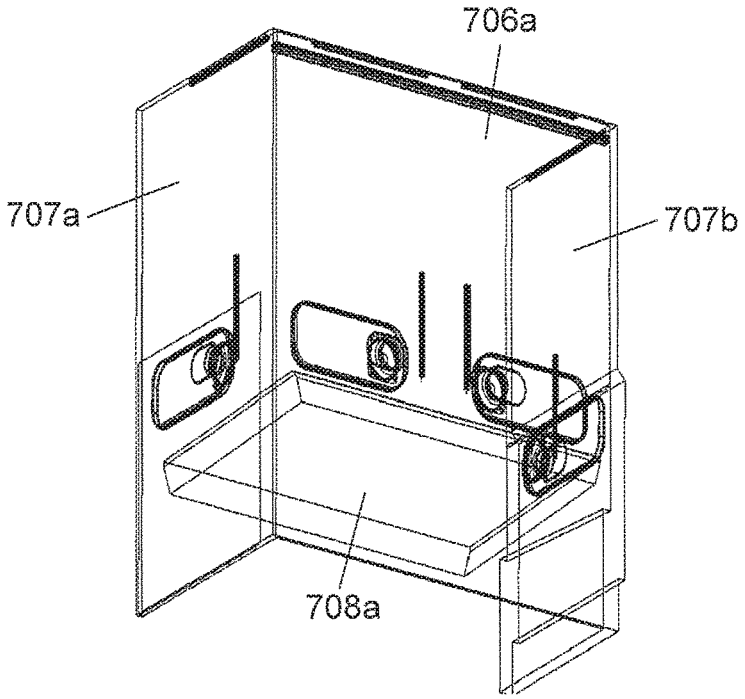
FIG. 23B is a view of the example of the further another embodiment according to the disclosure, showing the different arrangement from that of FIG. 4.

FIGS. 23A and 23B are views of examples of further another embodiment according to the present disclosure, showing different arrangements from that of FIG. 4. The views of FIGS. 23A and 23B illustrate back wall 706*a* of the shell, side walls 707*a* and 707*b* of the shell, and seat 708*a* disposed on the inside of the shell. FIGS. 23A and 23B show a state of the shell in which the seat is reclined to a fully-flat position.

Seat 708*a* is sometimes called a "bed" when being reclined to the fully-flat position. The seat is reclinable; the backrest angle can be adjusted steplessly from an upright position to the fully-flat position.

Figure 24A:
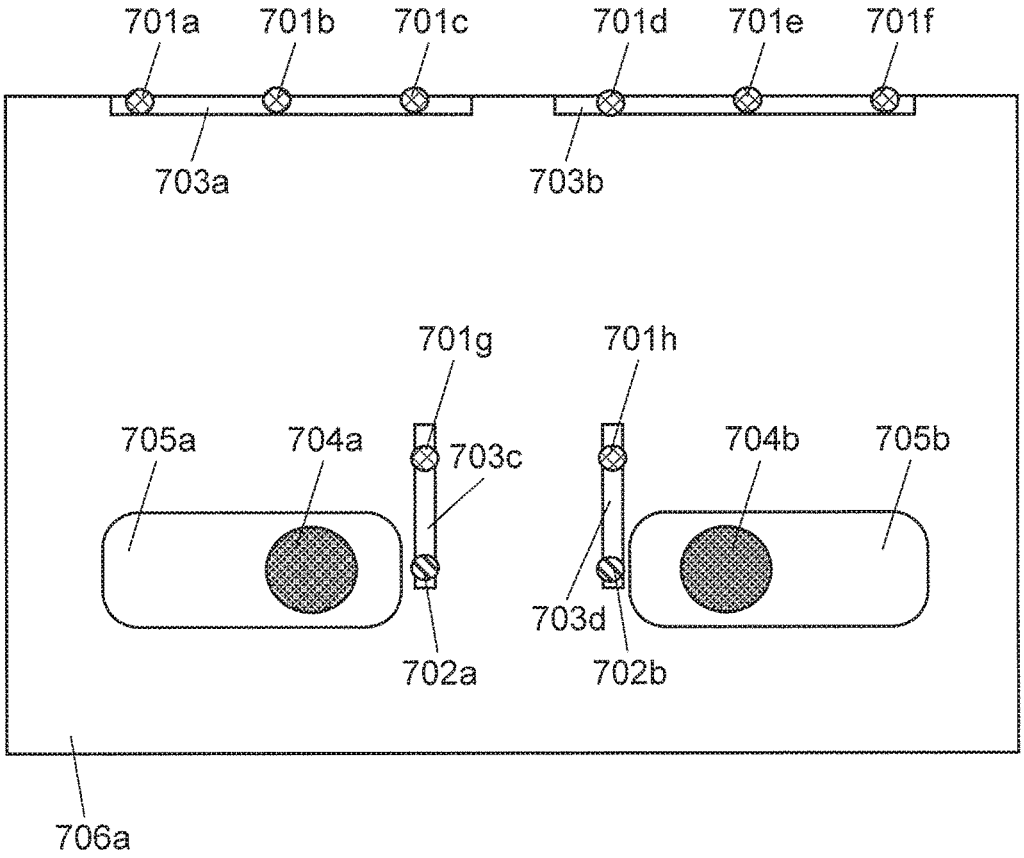
Figure 24B:
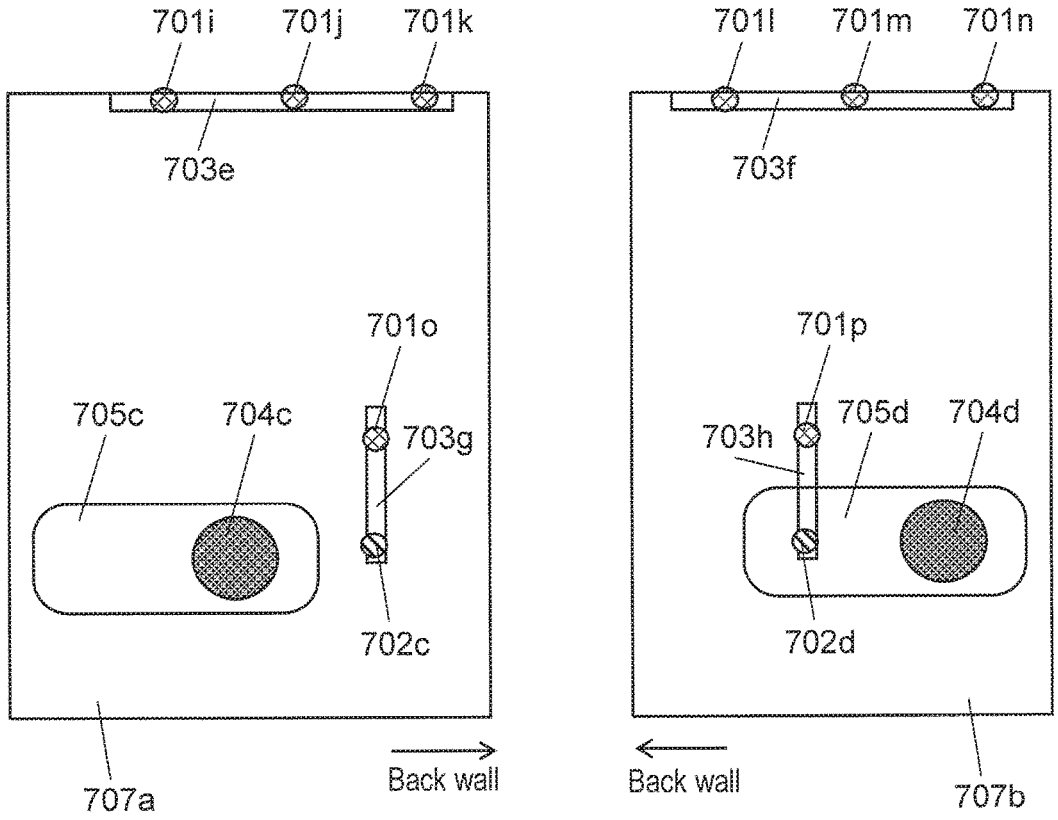
Figure 25A:
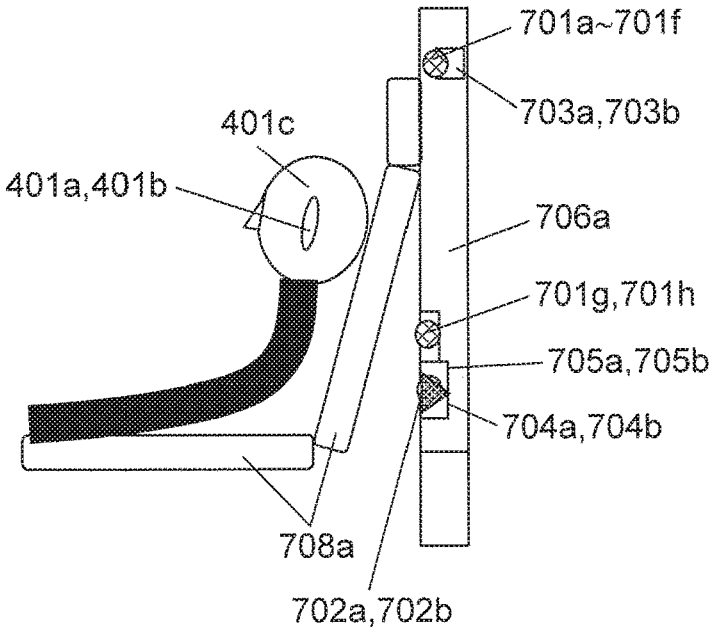
FIG. 25A is a view of an example of the position of a backrest when viewed from a lateral side, illustrating a state of the backrest being at the highest position (upright position)
Figure 25B:
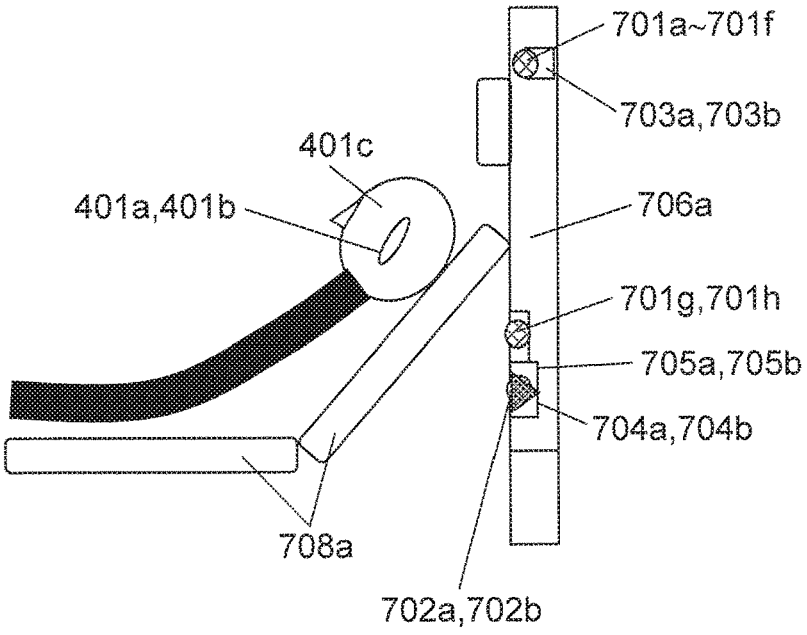
FIG. 25B is a view of an example of the position of the backrest when viewed from the lateral side, illustrating a state of the backrest being at a midpoint (relaxing position) between those of FIGS. 25A and 25C.
Figure 25C:
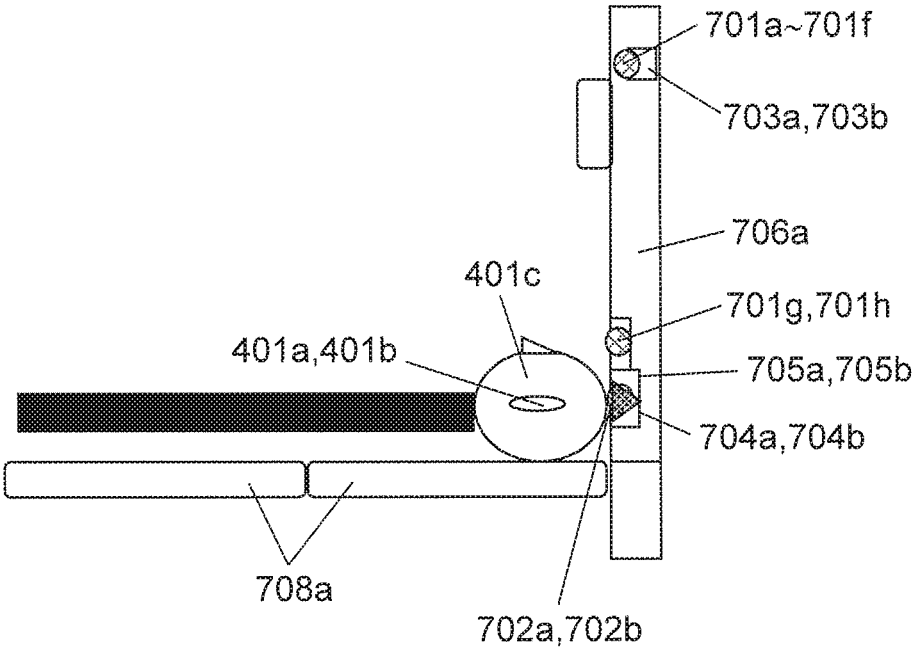
FIG. 25C is a view of an example of the position of the backrest when viewed from the lateral side, illustrating a state of the backrest being at a full-reclined position (fully-flat position)

Examples of positions are shown in FIGS. 25A, 25B, and 25C. FIG. 24A is an elevational view of back wall 706*a* of FIGS. 23A and 23B; FIG. 24B is elevational views of side walls 707*a* and 707*b* of FIGS. 23A and 23B. FIGS. 24A and 24B show an example of the arrangement of speakers, noise microphones, error microphones, and the like.

Noise microphones 701*a*, 701*b*, and 701*c* shown in FIG. 24A are ones that satisfy distance "d2" in Relational Expression (3) where "d0" is the distance from error microphone 702*a* to speaker 704*a*; noise microphone 701*g* in FIG. 24A is one that satisfies distance "d1" in Relational Expression (2). Likewise, noise microphones 701*d*, 701*e*, and 701*f* are ones that satisfy distance "d2" in Relational Expression (3) where "d0" is the distance from error microphone 702*b* to speaker 704*b*; noise microphone 701*h* is one that satisfies distance "d1" in Relational Expression (2).

Noise microphones 701*i*, 701*j*, and 701*k* shown in FIG. 24B are ones that satisfy distance "d2" in Relational Expression (3) where "d0" is the distance from error microphone 702*c* to speaker 704*c*; noise microphone 701*o* in FIG. 24B is one that satisfies distance "d1" in Relational Expression (2). Likewise, noise microphones 701*l*, 701*m*, and 701*n* are ones that satisfy distance "d2" in Relational Expression (3) where "d0" is the distance from error microphone 702*d* to speaker 704*d*; noise microphone 701*p* is one that satisfies distance "d1" in Relational Expression (2).

These noise and error microphones are each disposed to face the inside of the corresponding shell. This allows the microphones to be less prone to intrusion of water or the like if the water should be spilled thereon, resulting in an increased reliability of the microphones.

Moreover, noise microphones 701*a* to 701*f* and 701*i* to 701*n*, which are located on the upper side, are each also disposed to face the inside of the corresponding back and side walls of the shell. This allows the noise microphones to be not obstructed if someone should put a hand on the wall, resulting in a prevention of deterioration of the noise reducing effect.

Microphone cabinets (case units) 703*a* to 703*h* are each used to mount a plurality of the microphones in an array in the cabinet. This configuration allows ease of mounting the plurality of the microphones and ease of dismounting them for maintenance. Moreover, if distances between the microphones are set to be approximately equal to each other, in advance, the plurality of the noise microphones can be easily disposed at approximately regular intervals.

FIGS. 25A, 25B, and 25C show examples of the positions of the seat, i.e. the backrest, when viewed from a lateral side. FIG. 25A shows the state in which the backrest is at the highest position which is referred to as the "upright position" in the embodiment. FIG. 25C shows the state in which the backrest is at a full-reclined position which is referred to as the "fully-flat position." FIG. 25B shows the state in which the backrest is at a midpoint between those of FIG. 25A and FIG. 25C, which is referred to as a "relaxing position."

Seat 708*a* is reclinable freely in a position at any angle, which includes the upright position, relaxing position, and fully-flat position. In the fully-flat position, seat 708*a* can serve as a bed.

The noise microphones, error microphones, and speakers are preferably buried in the back and side walls, without any protrusions from the walls, such that the noise microphones, error microphones, and speakers do not hinder the seat from being reclined.

FIGS. 25A, 25B, and 25C show only noise microphones 701*a* to 701*h*, error microphones 702*a* and 702*b*, and speakers 704*a* and 704*b* which are all buried in back wall 706*a* that configures the shell and are set back from the surface of the back wall. However, the noise microphones, error microphones, and speakers in the side walls are also preferably buried in the walls, without any protrusions from the walls, such that the noise microphones, error microphones, and speakers do not hinder the seat from being reclined.

Figure 26:
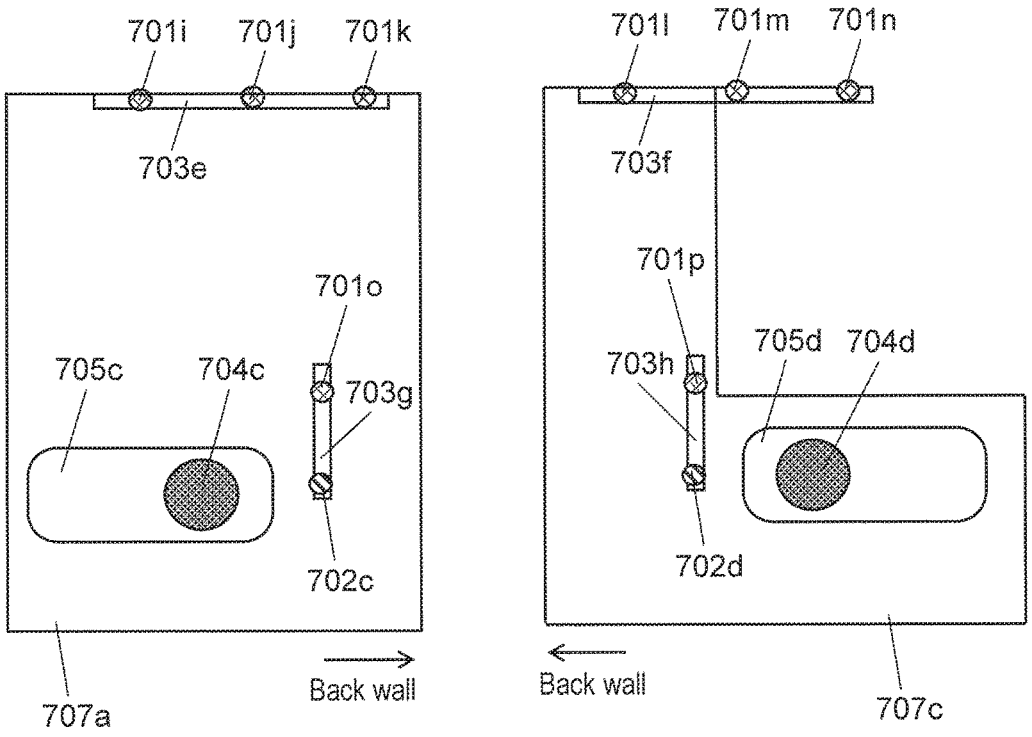
FIG. 26 is a view of an example of the arrangement of the speakers, microphones, and the like, in a case where a part of the side wall of the shell is open.

FIG. 26 shows an example of an arrangement of the speakers, microphones, and the like in a case where a part of side wall 707*c* of the shell is open. As in the case of FIG. 24B, noise microphones 701*i*, 701*j*, and 701*k* in FIG. 26 are ones that satisfy distance "d2" in Relational Expression (3) where "d0" is the distance from error microphone 702*c* to speaker 704*c*; noise microphone 701*o* in FIG. 26 is one that satisfies distance "d1" in Relational Expression (2). Likewise, noise microphones 701*l*, 701*m*, and 701*n* are ones that satisfy distance "d2" in Relational Expression (3) where "d0" is the distance from error microphone 702*d* to speaker 704*d*; noise microphone 701*p* is one that satisfies distance "d1" in Relational Expression (2).

Figure 27A:
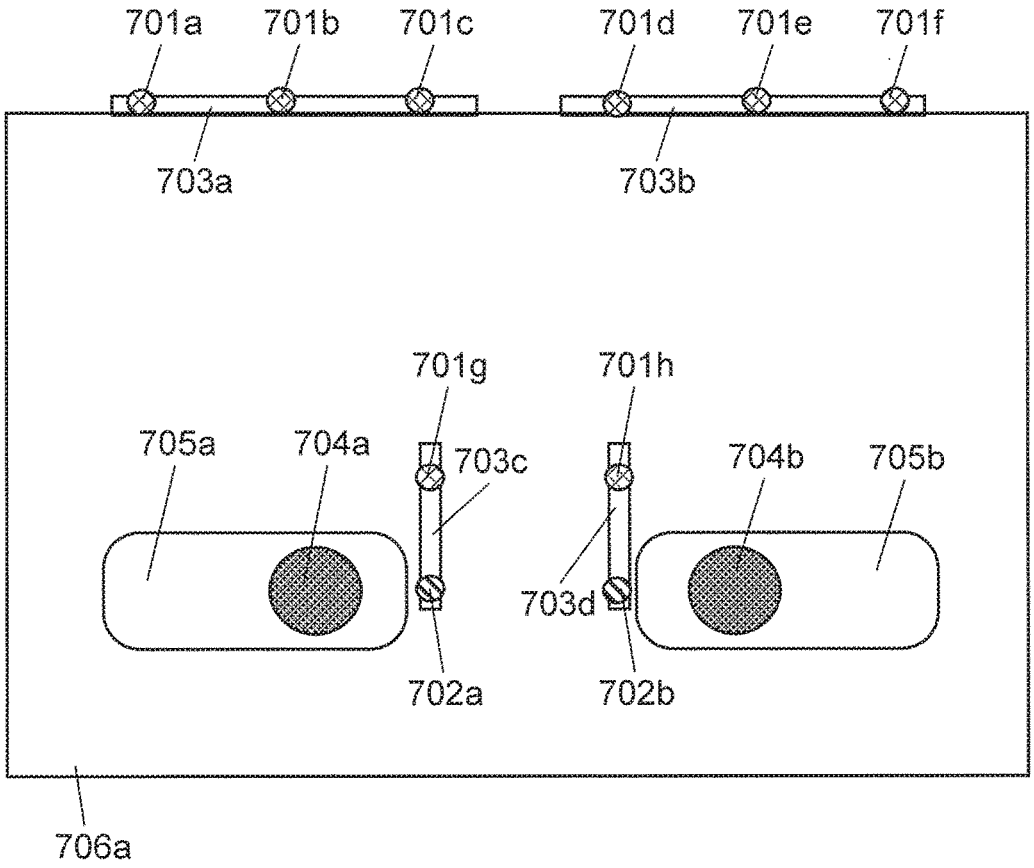
FIG. 27A is a view of an example in which the noise microphones are disposed in a top part of the back wall.
Figure 27B:
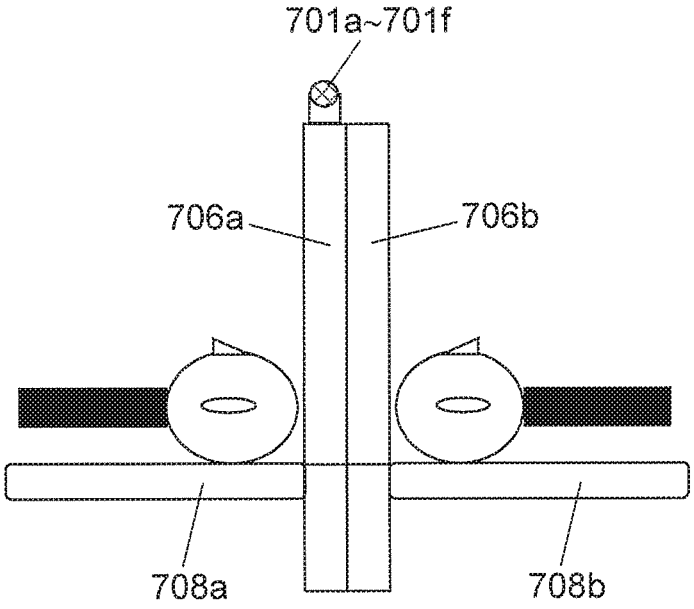
FIG. 27B is a side elevational view of both the seat shown in FIG. 27A and the next (back) seat.

FIG. 27A shows an example in which noise microphones 701*a* to 701*f* are disposed on a top part of back wall 706*a* that configures the shell. Moreover, FIG. 27B shows a side elevational view of both the seat shown in FIG. 27A and the next (back) seat. In this case, as shown in FIG. 27B, noise microphones 701*a* to 701*f* can be shared between the front and back seats, resulting in a reduction in the number of the noise microphones. In FIG. 27B, the next (back) seat is seat 708*b* with back wall 706*b*. As in the case of seat 708*a*, seat 708*b* as well serves as a bed in a fully-flat mode, being sometimes called a "bed."

In this case, the example has been described in which the noise microphones of the back wall are disposed on the top part of back wall 706*a* that configures the shell. Likewise, the noise microphones may be disposed on top parts of the side walls, which allows the noise microphones to be shared between laterally adjacent seats, resulting in a reduction in the number of the noise microphones.

Figure 28A:
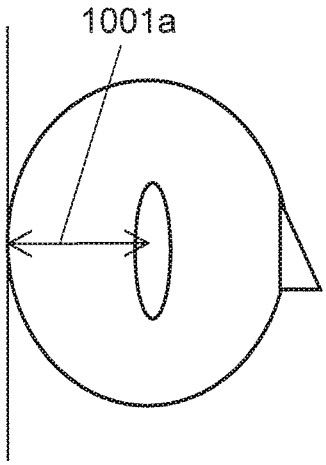
FIG. 28A is a view illustrating a distance from the back of a head to each of traguses, for the adult males and females falling within a distribution range from 5% to 95%.

Here, as shown in FIG. 28A, according to the AIST Anthropometric database 1991-1992, for the adult males and females falling within a distribution range from 5% to 95%, distance 1001*a* from the back of head to each of the traguses ranges from 77 mm to 99 mm. Moreover, as shown FIG. 28B, for the adult males and females falling within a distribution range from 5% to 95%, distance 1001*b* from the top of head to each of the traguses ranges from 124 mm to 147 mm.

Moreover, in FIG. 25C, the error microphones 702*a* and 702*b* are preferably set to be closer to the positions of ears 401*a* and 401*b* (the positions of the traguses). This is because the noise reduction device performs the control such that the noise is reduced to a lowest possible level at the positions of the error microphones. Thus, the noise reduction effect becomes better at positions of the user's ears closer to the error microphones. Therefore, when the error microphones are disposed, the error microphones are preferably set at the same positional height as that of ears 401*a* and 401*b*.

Furthermore, speakers 704*a* and 704*b* as well are preferably set at the same positional height as that of ears 401*a* and 401*b*. The reason for this is as follows:

The distance between the speaker and each of the traguses is preferably made equal to the distance between the speaker and the error microphone. This is because this configuration causes a sound pressure at the error microphone to become equal to that at the tragus, which allows the noise reduction effect at the position of the tragus to become closer to that at the position of the error microphone.

There is considered a distribution range of positions in which the distance between the speaker and the tragus is equal to the distance between the speaker and the error microphone. Such a distribution range reaches a maximum at the positional height of the speaker and error microphone from the bed. This is because, since the positional height of the user's head is constant in a state of the user lying on the bed, the positional heights of the ears are constant. Thus, in this case, the region in which the sound reduction effect at the ears becomes closer to the sound reduction effect at the error microphone, reaches a maximum.

Moreover, a smaller distance of the speaker from the error microphone is preferable. The reason for this is as follows: Smaller distance "d0" of the speaker from the error microphone in Relational Expression (1) results in a smaller distance "d" of the noise microphone in Relational Expression (1), which allows a noise microphone that satisfies distance "d2" in Relational Expression (3) to be disposed at a position closer to the error microphone. This configuration provides a high correlation between the noise microphone and the error microphone, resulting in an expected high effect of the noise reduction. Moreover, the smaller the distance of the speaker from the error microphone, the smaller the speaker's sound volume required enough to produce a sound pressure for reducing the noise at the position of the error microphone is. Such a smaller sound volume, in turn, requires only a less load on the speaker. Moreover, even if the user's ear should accidentally come close to the speaker, there is a low possibility that the user suffers an increased noise.

From the above conditions, it follows that the distance of the speaker from the error microphone is preferably smaller than 147 mm, i.e. the upper limit of the distance between the top of head and each of the traguses, for adult males and females falling within the distribution range from 5% to 95%.

It is noted, however, that there are other conditions of phase in addition to the conditions of sound pressure, for achieving the noise reduction effect. If the phase of the control sound should shift by $\lambda/6$, the energy of a wave which is formed by superimposing two waves, i.e. the noise and the control sound, becomes equal to the energy of the original noise, resulting in a failure in noise reduction.

For example, assuming that the control frequency is 500 Hz and the sound speed is 340 m/s, then $\lambda/6$ is approximately 113 mm. That is, when the distance of the speaker from the error microphone is not larger than 34 mm=147 mm−113 mm, the noise reduction effect cannot be achieved at the positions of the user's ears even though the noise reduction effect is obtained at the position of the error microphone.

Figure 37:
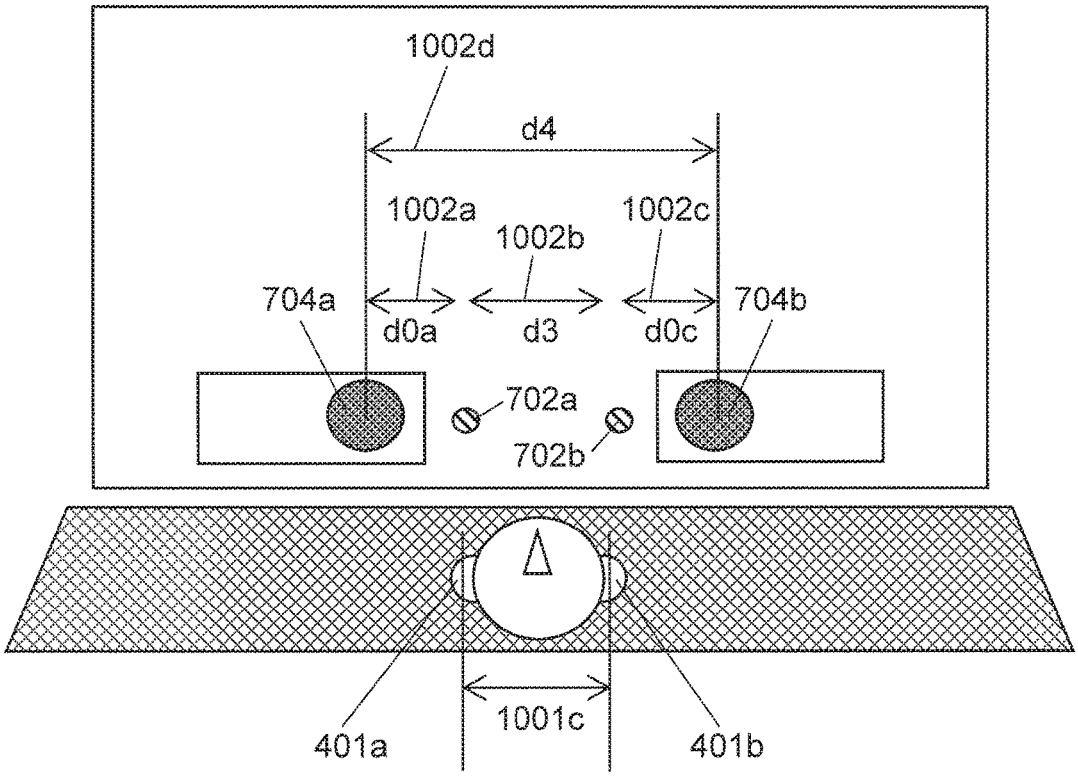
FIG. 37 is a view of an arrangement of the speakers and error microphones in the back wall.

FIG. 37 is a view of a part of the configuration shown in FIG. 25C when viewed from the front. From the above description, it follows that Relational Expression (7) for d0a and d0c shown below is preferably held, where d0a and d0c are each the distance of the speaker from the corresponding error microphone. Here, "λ" is the wavelength corresponding to control upper-limit frequency "f," in the same manner as for Relational Expressions (1), (4), and (6).

$$d0a > 147 - \lambda/6 \text{ (mm)},$$

$$d0c > 147 - \lambda/6 \text{ (mm)} \quad (7)$$

Figure 38A:
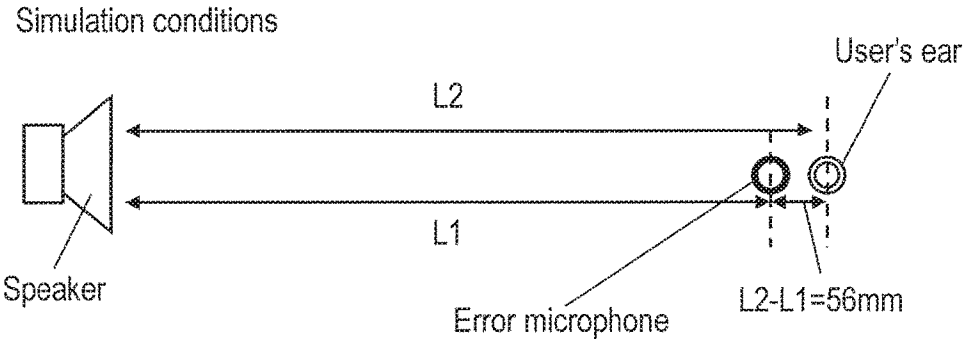
FIG. 38A is a view illustrating conditions of a simulation to verify the noise reduction effect of the noise reduction device.
Figure 38B:
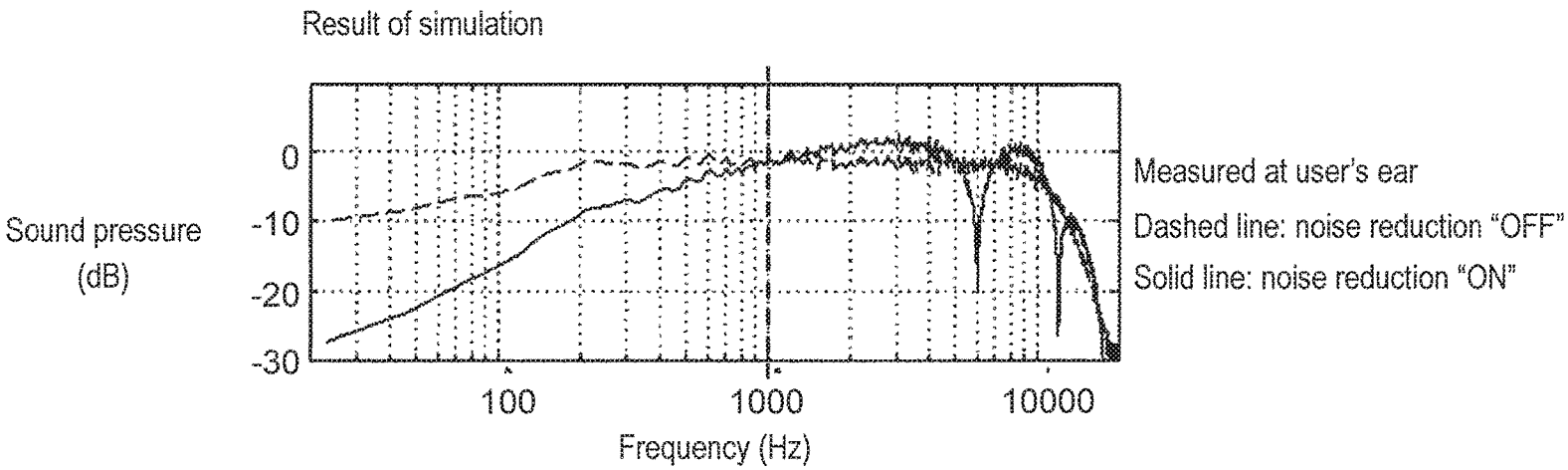
FIG. 38B is a view illustrating the result of the simulation to verify the noise reduction effect of the noise reduction device.

FIGS. 38A and 38B are views illustrating the conditions and the result of a simulation with $\lambda/6$=56 mm, respectively. The result shows that "f" is approximately 1 kHz in this case. Then, at frequencies not lower than 1 kHz, the noise reduction effect cannot be achieved at the positions of the user's ears even though the effect is obtained at the position of the error microphone; and the noise rather adversely increases.

Here, when f=385 Hz, $\lambda/6$=approximately 147 mm. From this, it follows that the value in Relational Expression (7)

equals approximately 0 (zero) mm. Therefore, in the case of "f" being not higher than 385 Hz, the noise reduction is determined only by the conditions of sound pressure and the minimum value of the distance of the speaker from the error microphone is 0 (zero) mm.

In consideration of a common practice of user 401, i.e. a cushion, pillow, or the like is often placed between the bed (seat 708*a*) and head 401*c*, the positional height of the speaker from the upper surface of the bed is preferably set to be not smaller than 77 mm that is the minimum distance between the back of head and each of the traguses, for adult males and females who fall within the distribution range from 5% to 95%.

Even without placing any cushion or pillow, it should be considered that the bed (seat 708*a*) is reclinable as shown in FIGS. 25A, 25B, and 25C. Accordingly, the positional height of the speaker from the upper surface of the bed is preferably set within a region up to the positions of ears 401*a* and 401*b* in FIG. 25B that shows the relaxing position, i.e. a mid-position between the fully-flat position and the upright position.

In this case, the noise reduction effect can be expected at positions between the fully-flat position and the relaxing position.

Assuming that the positional height of the cushion or pillow is 10 mm, the positional height of the speaker from the upper surface of the bed is then preferably in a range from 87 mm to 109 mm. Note that, although the positional height of the speaker is determined on a speaker-center reference basis, the noise reduction effect is held as long as the position concerned is within a region of the opening of the speaker.

Figure 29:
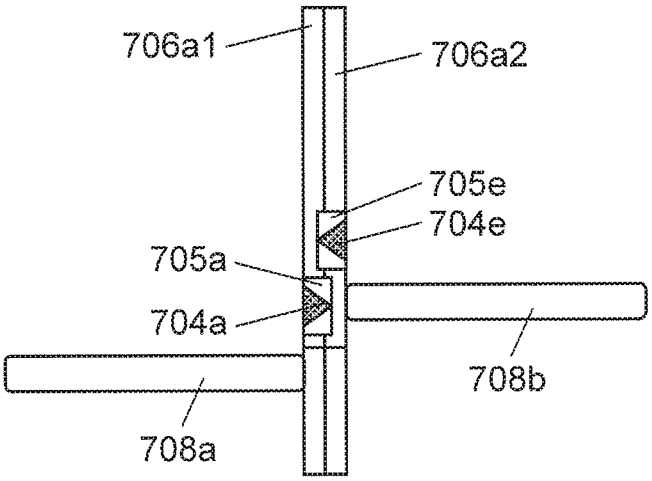
FIG. 29 is a view illustrating a case where beds are different in height between the front and back seats.

FIG. 29 shows a case where the beds are different in height between the front and back seats.

As described above, the speakers are preferably buried in back walls 706*a* and 706*b*, without any protrusions from the walls, such that the speakers do not hinder the seats from being reclined. The positional height of speaker cabinet 705*a* of the front seat is set to be different from that of the speaker cabinet of the back seat, which allows a reduced thickness of back walls 706*a* and 706*b* without any interference between the speaker cabinets.

That is, speaker cabinet 705*a* of the front seat is buried also in back wall 706*b* of the back seat, while speaker cabinet 705*e* of the back seat is buried also in back wall 706*a* of the front seat.

This configuration allows a reduction in thickness of back walls 706*a* and 706*b*, which in turn allows the larger area to be allocated for users even in the same cabin area, resulting in an improved passenger comfort.

Note that, in FIG. 29, the case has been described where the positions of the speakers are set to be different, in the height direction, between the front and back seats. However, the speaker's positional difference is not limited to this; their positions may be set to be different in any direction including a left-to-right direction and a slanting direction. Moreover, the speakers of side walls of laterally adjacent seats can be disposed in the same manner as this, which allows a reduction in thickness of the side walls.

Figure 30A:
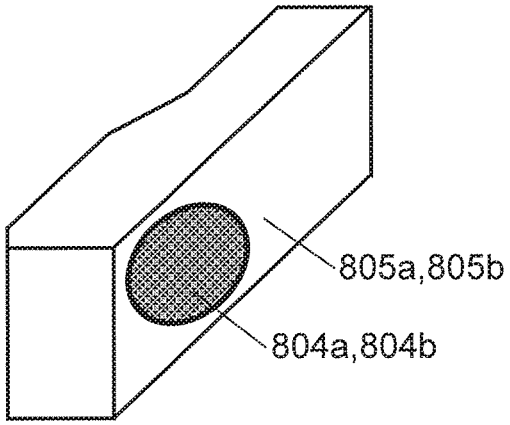
FIG. 30A is a view of a speaker unit configured with a speaker and a speaker cabinet.

FIG. 30A shows a speaker unit which is configured with speakers 804*a* and 804*b* and speaker cabinets (case units) 805*a* and 805*b*, respectively. Speakers 804*a* and 804*b* are asymmetrically disposed with respect to speaker cabinets 805*a* and 805*b*, respectively. The depths of speaker cabinets 805*a* and 805*b* are deep backward only at the mounting portions of speakers 804*a* and 804*b*, respectively, and are shallow at the other portions.

Figure 30B:
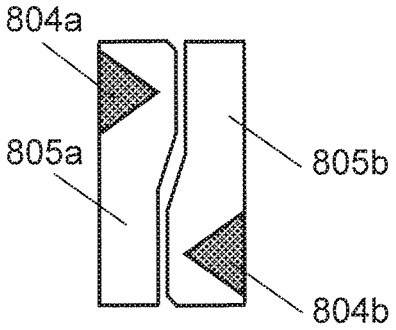
FIG. 30B is a view of a configuration of the speakers having a deep depth.

Use of such speakers causes no interference between speaker cabinets 805*a* and 805*b* even if speakers 804*a* and 804*b* have a deep depth, as shown in FIG. 30B, which allows speakers 804*a* and 804*b* to be arranged closer to each other. In cases where such speaker cabinets 805*a* and 805*b* are buried in the back walls of the front and back seats, the back walls can be made thinner which allows the larger area to be allocated for users even in the same cabin area, resulting in an improved passenger comfort.

Figure 30C:
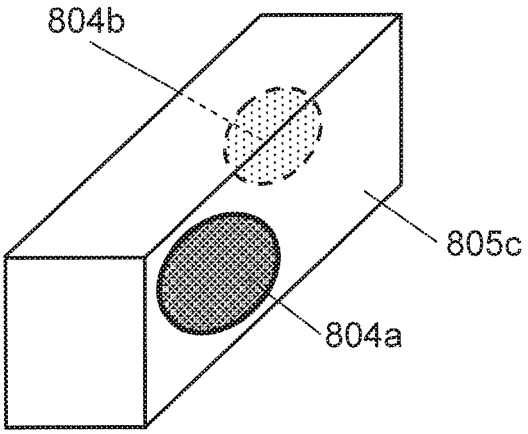
FIG. 30C is a view of a configuration using a speaker cabinet, a cabinet volume of which is shared by speakers.
Figure 30D:
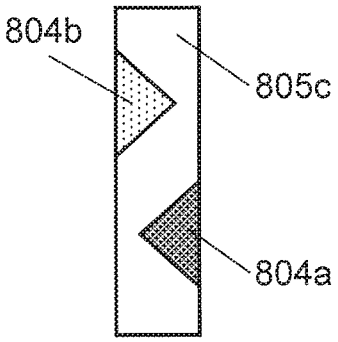
FIG. 30D is a view of the configuration using the speaker cabinet, the cabinet volume of which is shared by the speakers.

Moreover, the configuration may be such that speaker cabinet 805*c* permits a shared use of its cabinet volume for speakers 804*a* and 804*b*, as shown in FIGS. 30C and 30D.

In this case as well, speakers 804*a* and 804*b* can be arranged closer to each other, resulting in the thinner back walls when the speaker cabinet is buried in the back walls of the front and back seats. This allows the larger area to be allocated for users even in the same cabin area, resulting in an improved passenger comfort.

In general, the larger the volume of the speaker cabinet, the higher the performance of the speaker is. This means that, for achieving the same performance of the speakers, a required cabinet volume in total of the speaker cabinet(s) is smaller in the shared use of speaker cabinet 805*c* than in the exclusive use of the speaker cabinets separately for speakers 804*a* and 804*b*. With this configuration, the achievement of the same performance requires only a smaller volume of the speaker cabinet, which, in turn, requires only a smaller space of the back walls to bury the speaker cabinet therein. Such a configuration allows a reduced thickness of the back walls as well as a higher strength of the back walls, which results in the larger area to be allocated for users even in the same cabin area, leading to an improved passenger comfort.

Figure 31:
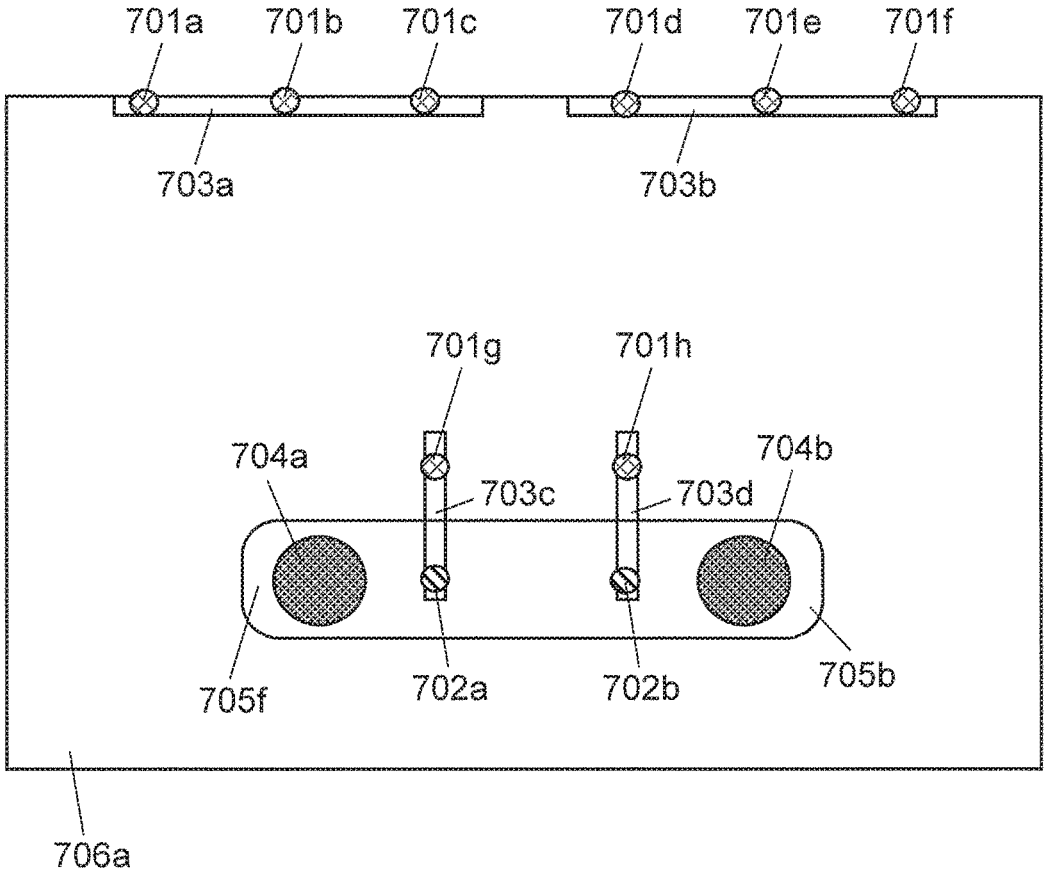
FIG. 31 is a view of a configuration using a speaker cabinet, a cabinet volume of which is shared by a plurality of speakers disposed in one seat.

In the embodiment, the case has been described regarding the back walls of the front and back seats; however, the case holds for the side walls of the laterally adjacent seats as well. Moreover, as shown in FIG. 31, the configuration may use speaker cabinet 705*f*, a cabinet volume of which is shared by a plurality of speakers disposed in one seat.

In this case as well, the configuration requires only a smaller space of the back wall to bury the speaker cabinet therein. This allows a reduced thickness of the back walls as well as a higher strength of the back walls, which results in the larger area to be allocated for users even in the same cabin area, resulting in an improved passenger comfort.

Figure 32:
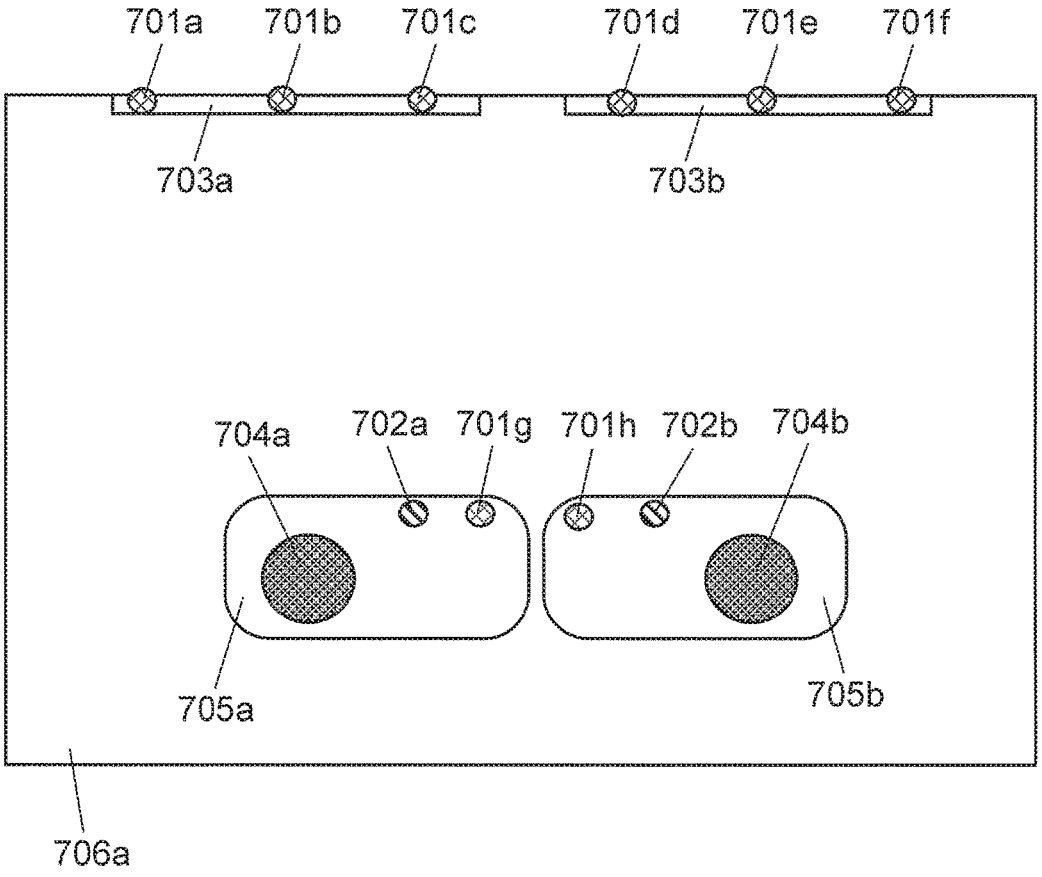
FIG. 32 is a view of an example in which a noise microphone and an error microphone are integrated with a speaker cabinet into a one-piece unit.

FIG. 32 shows an example in which noise microphones 701*g* and 701*h* and error microphones 702*a* and 702*b* are integrated with speaker cabinets 705*a* and 705*b* into one-piece units, respectively. The integration of the microphones with the speaker cabinet allows ease of mounting the microphones and ease of dismounting them for maintenance. The speaker cabinet may be integrated only with the noise microphone, or only with the error microphone, or with the both.

Figure 33:
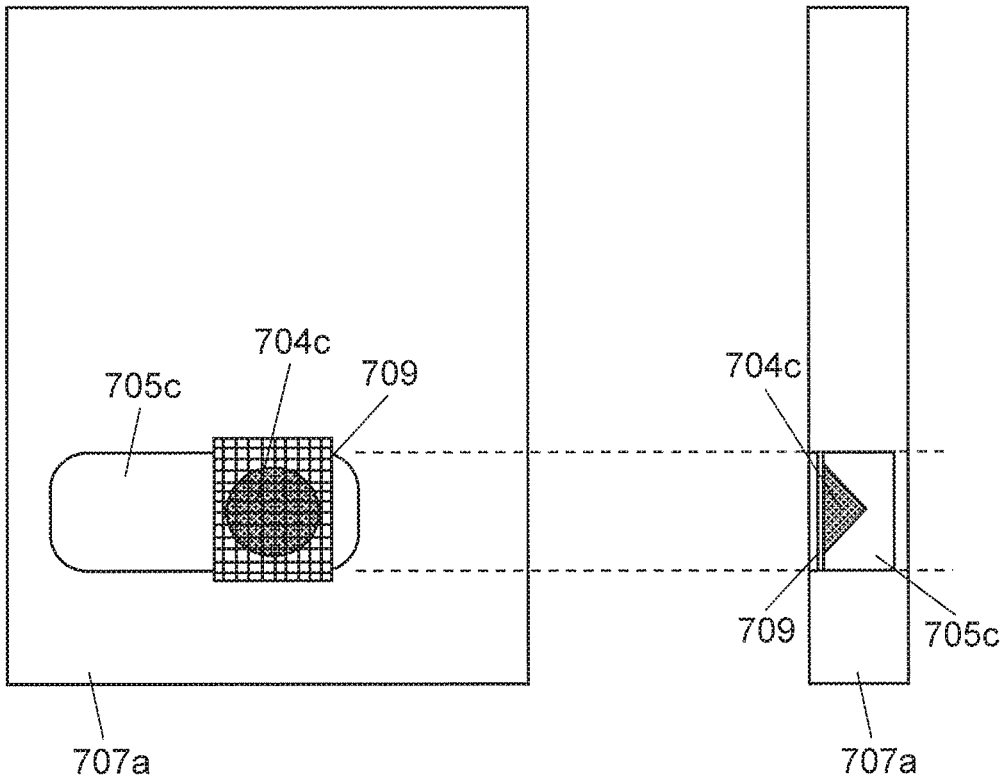
FIG. 33 is a view of an example of a speaker guard configured with a speaker cabinet and a speaker which both are buried together in a wall surface (of the side wall) in a mesh structure that is integrated with the side wall.

FIG. 33 shows speaker guard (guard member) 709. Speaker cabinet 705*c* and speaker 704*c* are buried together in wall surface 707*a* (of the side wall). Speaker guard 709 is configured in a mesh structure, being integrated with the side wall.

This configuration eliminates the need for separately preparing a speaker guard and the need for an additional process of mounting the guard. In addition, such an integrated structure of the speaker guard with the side wall is so strong that the guard can prevent the speaker from being touched by the user. This prevents deterioration of the noise reduction effect and failures of the speaker which both are caused by the touching.

Figure 34:
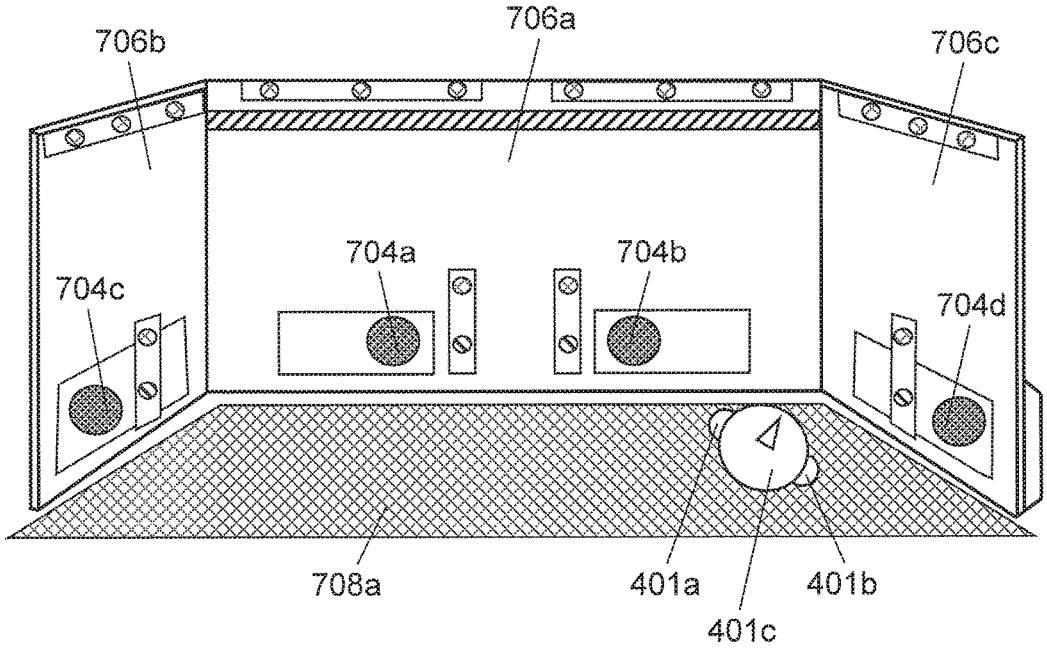
FIG. 34 is a view of an example of further another arrangement of the speakers.

FIG. 34 shows an example of the arrangement of speakers 704*a* to 704*d*. The speakers are disposed in at least two surfaces. This configuration can achieve the same effect even if head 401*c* of the user is positioned either between back wall 706*a* and side wall 706*b* or between back wall 706*a* and side wall 706*c*. In accordance with the position of head 401*c* of the user, the speakers may be disposed either in back wall 706*a* and side wall 706*b* or in back wall 706*a* and side wall 706*c*; however, the configuration is not limited to this.

Moreover, as shown in FIG. 34, the speakers may be disposed in three surfaces of back wall 706*a* and side walls 706*b* and 706*c*, thereby achieving the noise reduction effect even if head 401*c* is positioned closer to whichever one of the side walls.

In this way, even in the case where the plurality of the speakers and the plurality of the error microphones are disposed in one seat, the distance of each of the speakers from the corresponding error microphone is preferably not larger than 147 mm. With this configuration, setting the distances of the speakers from the corresponding error microphones to be approximately equal to each other, allows the sound volumes of the speakers to become close to each other, resulting in a distributed speaker's load among the speakers. Moreover, this configuration allows the noise reduction effect to become uniform over a wide region. Therefore, in the case where the speakers and error microphones are disposed particularly in the back and side walls, variations in the noise reduction effect are small even when the user's ears move along the surface of the bed. This allows the user to feel a comfortable noise reduction effect over a wide region.

Figure 35:
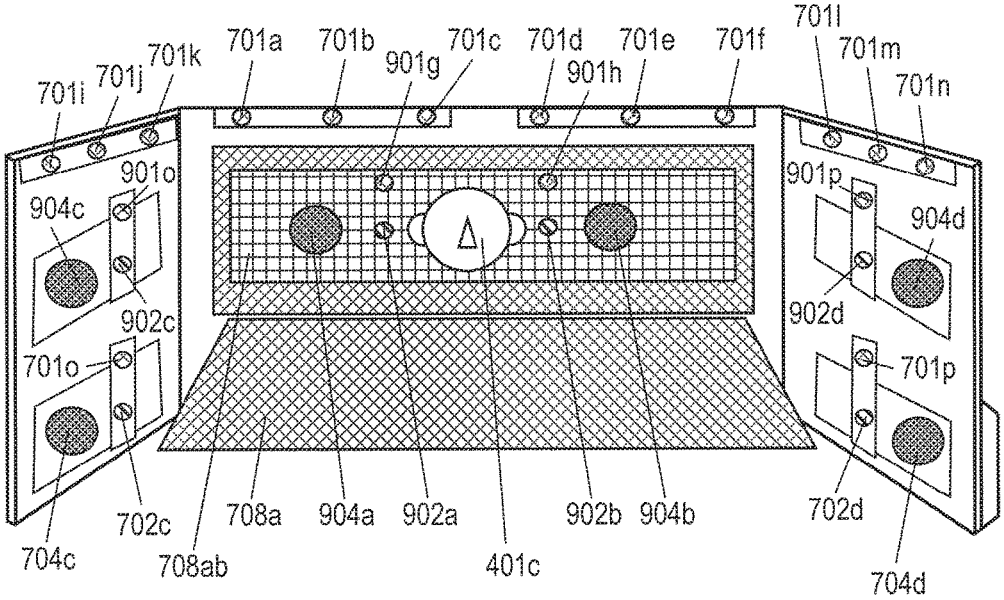
FIG. 35 is a schematic view of a noise reduction device which is functional for at least two reclining positions of the seat.

FIG. 35 shows a schematic view of a noise reduction device which is functional for at least two reclining positions of the seat. The noise reduction device includes: noise microphones 701*a* to 701*f*, 701*i* to 701*p*, 901*g*, 901*h*, 901*o*, and 901*p*; error microphones 902*a* to 902*d*, 702*c*, and 702*d*; and speakers 904*a* to 904*d*, 704*c*, and 704*d*.

Noise microphones 901*g* and 901*h*, error microphones 902*a* and 902*b*, and speakers 904*a* and 904*b* are buried in headrest 708*ab* that is a part of seat 708*a*. These microphones and speakers move together with head 401*c* of the user, in response to the change of reclining.

The speakers and noise and error microphones buried in the headrest and noise microphones 701*a* to 701*f* and 701*i* to 701*n* are all used on a shared basis regardless of the seat position.

In the case where the headrest on which head 401*c* lies is set above the mid-position (e.g. set at the relax position or the upright position), the noise reduction is performed not only through use of the noise microphones, error microphones, and speakers on a shared basis, but also through additional use of noise microphones 901*o* and 901*p*, error microphones 902*c* and 902*d*, and speakers 904*c* and 904*d*, which are disposed in upper portions of the side walls.

In contrast, in the case where the headrest is set below the mid-position (e.g. set at the fully-flat position), the noise reduction is performed not only through use of the noise microphones, error microphones, and speakers on a shared basis, but also through additional use of noise microphones 701*o* and 701*p*, error microphones 702*c* and 702*d*, and speakers 704*c* and 704*d*, which are disposed in lower portions of the side walls.

With this operation, the microphones and speakers buried in the headrest are capable of efficiently performing the noise reduction because they move together with head 401*c*.

Moreover, of the microphones and speakers of the side walls, only ones that are positioned closer to head 401*c* are used, which allows a reduction in power consumption and in adverse influence on the noise reduction effect.

In the embodiment, the description has been made regarding the case where the microphones and speakers to be used are changed on the basis of whether the headrest is positioned above the mid-position or below it. However, the configuration is not limited to this. Alternatively, the microphones and speakers to be used may be changed in not smaller than three modes on the basis of where the headrest is positioned. Moreover, the noise reduction may be performed without use of the side-walls' microphones and speakers to be used in response to the seat position, but through use of the noise microphones on a shared basis and the microphones and speakers buried in the headrest.

Furthermore, the noise reduction may be performed in such a manner that, for example, the function of the noise reduction is activated when the seat is set at a predetermined position, e.g. the fully-flat position, and/or the function is deactivated when the seat is set out of a predetermined position; however, the configuration is not limited to this.

Such predetermined positions may configure a set of positions including: a set of the upright, relaxing, and fully-flat positions; and a set of the relaxing and fully-flat positions, for example.

Figure 36A:
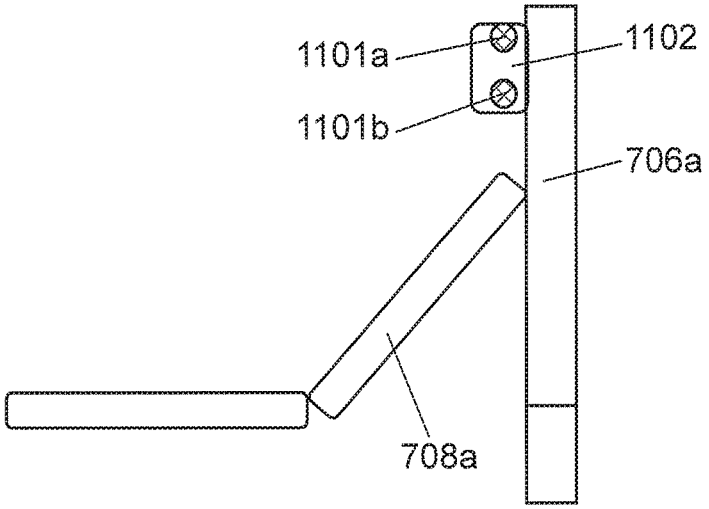
FIG. 36A is a view of an example of an arrangement of the noise microphones in the case where the back wall is equipped with an unmovable protrusion such as a cushion.

FIG. 36A shows an example of arrangement of the noise microphones in the case where back wall 706*a* is equipped with unmovable protrusion 1102 such as a cushion.

Arranging the noise microphones at the periphery of protrusion 1102 prevents the microphones from being obstructed by a user. In the case where noise microphone 1101*a* is disposed in an upper portion of protrusion 1102 such as a cushion, it is possible to prevent the noise reduction effect from being decreased due to touching of noise microphone 1101*a* by the user.

Moreover, in the case where noise microphone 1101*b* is disposed in a lower portion of protrusion 1102 such as a cushion, the noise microphone can detect a noise at a position close to the user, which allows collection of the noise which has a high correlation with the noise detected by the error microphone. This allows the highly effective noise reduction.

Furthermore, protrusion 1102 is considered to include a headrest and a lighting fixture besides the cushion; however, the protrusion is not limited to them. The protrusion may include movable one.

Figure 36B:
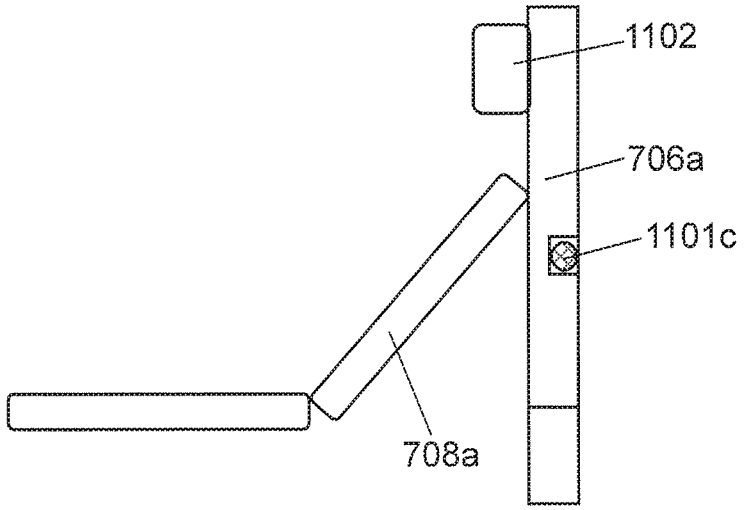
FIG. 36B is a view of an example of the noise microphone disposed on an outer side of the back wall.

FIG. 36B shows an example of noise microphone 1101*c* that is disposed on an outer side of the back wall. This configuration can prevent noise microphone 1101*c* from being obstructed by a user and prevent noise microphone 1101*c* from being touched by the user, thereby preventing deterioration in the noise reduction effect. Moreover, noise microphone 1101*c* is less prone to intrusion of user's voice and the like, which eliminates a voice echo problem.

Up to here, the descriptions of FIGS. 36A and 36B have been made regarding the cases of the back walls; however, the configurations are not limited to them and are also applicable to the side walls.

FIG. 37 shows the arrangement of speakers 704*a* and 704*b* and error microphones 702*a* and 702*b* in the back wall.

Figure 28B:
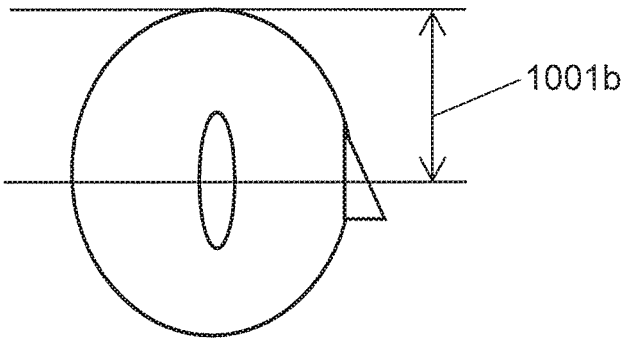
FIG. 28B is a view illustrating a distance from the top of the head to each of the traguses, for the adult males and females falling within a distribution range from 5% to 95%.

Distance 1002*a* of speaker 704*a* from error microphone 702*a* and distance 1002*c* of speaker 704*b* from error microphone 702*b* are each preferably not larger than distance 1001*b* between the top of head and each of the traguses shown in FIG. 28B.

According to the AIST Anthropometric database 1991-1992, for adult males and females falling within the distribution range from 5% to 95%, distance 1001*b* from the top of head to each of the traguses ranges from 124 mm to 147 mm.

In addition, the distance between error microphones 702*a* and 702*b* is preferably equivalent to tragus-to-tragus distance 1001*c*.

The reason for this is as follows: Setting the distance between the error microphones to be equal to the tragus-to-tragus distance, reduces a difference in the amount of the noise reduction between the left and right sides, which allows the user to have less strange feeling caused by such a difference between the left and right sides. Therefore, error microphones 702*a* and 702*b* can be disposed closer to the left and right ears, i.e., 401*a* and 401*b*, respectively, which thereby enhances the noise reduction effect.

According to the AIST Anthropometric database 1991-1992, for adult males and females falling within a distribution range from 5% to 95%, tragus-to-tragus distance 1001*c* ranges from 136 mm to 157 mm. Therefore, distance 1002*a* (d0a) of the speaker from the error microphone and distance 1002*c* (d0c) of the speaker from the error microphone are each preferably not larger than 147 mm; and distance 1002*b* (d3) between the error microphones is preferably not smaller than 136 mm and not larger than 157 mm. In this case, the value in Relational Expression (7) becomes not larger than 0 (zero) at frequencies not higher than control upper-limit frequency f=385 Hz, causing the distance of the speaker from the error microphone to be "zero." From taking this situation into consideration, it follows that speaker-to-speaker distance 1002*d* (d4) in this case is preferably not smaller than 136 mm and not larger than 451 mm.

Moreover, when the conditions of phase as well in Relational Expression (7) is taken into the consideration, speaker-to-speaker distance 1002*d* (d4) preferably satisfies Relational Expression (9), which is reduced from Relational Expression (8), and is preferably not larger than 451 mm.

$$d4>136+2\times(147-\lambda/6)\ (\text{mm}) \tag{8}$$

$$d4>430-\lambda/3\ (\text{mm}) \tag{9}$$

For example, when control upper-limit frequency f=500 Hz, the speaker-to-speaker distance is preferably not smaller than 203 mm and not larger than 451 mm. When f=1 kHz, the speaker-to-speaker distance is preferably not smaller than 317 mm and not larger than 451 mm.

Here, the value of 451 mm is a sum of the maximum (147 mm) of preferable d0a, the maximum (147 mm) of preferable d0c, and the maximum (157 mm) of preferable d3.

The positions of the speakers are determined on a speaker-center reference basis; therefore, speaker-to-speaker distance 1002*d* is the distance between the centers of the speakers.

For example, with the speakers each having a radius of 50 mm, the distance between the edges of the speakers is preferably not smaller than 36 mm and not larger than 351 mm at frequencies not larger than f=385 Hz.

Note that, although the description has been made using the speaker-to-speaker distance that is defined as the distance between the centers of the speakers, the noise reduction effect is held as long as the position concerned is within regions of the openings of the speakers.

Moreover, in the embodiment, the description has been made regarding the speakers of the back wall; however, the configuration is not limited to this. That is, the description also holds for the distance between the speakers in the back and side walls, and the distance between the speakers in the side walls.

What is claimed is:

1. A noise reduction device used together with a shell surrounding at least a part of a periphery of a reclinable seat reclinable between a first position and a second position, the noise reduction device comprising:

a plurality of noise detectors for detecting a noise;

a noise controller for generating a control-sound signal to reduce, at a control center of a control space, the noise detected by the plurality of noise detectors;

a control-sound generator for outputting a control sound based on the control-sound signal; and a residual-sound detector for detecting a residual sound resulted from superimposition, onto the noise, of the control sound output from the control-sound generator, wherein each of the plurality of noise detectors is accommodated in a wall configuring the shell along which a back seat of the reclinable seat slides, and is set back from a surface of the wall, the residual-sound detector is disposed at the wall, at least one first noise detector among the plurality of noise detectors is located at a position not covered by the back seat when the reclinable seat is at the first position, and at least one second noise detector among the plurality of noise detectors and the residual sound detector are located at a position covered by the back seat when the reclinable seat is at the first position, and not covered by the back seat when the reclinable seat is at the second position.

2. The noise reduction device according to claim 1, wherein the plurality of noise detectors configures one set, and the plurality of noise detectors of the one set are disposed at approximately equal spacing-intervals.

3. The noise reduction device according to claim 1, wherein the plurality of noise detectors is disposed in a microphone cabinet disposed in the shell.

4. The noise reduction device according to claim 1, wherein the control-sound generator and the residual-sound detector are disposed in one wall configuring the shell, and a distance of the control-sound generator from the residual-sound detector is not smaller than 0 (zero) mm and not larger than 124 mm on the one wall.

5. The noise reduction device according to claim 4, wherein each of the plurality of noise detectors is disposed so as not to protrude from a surface of a wall configuring the shell.

6. The noise reduction device according to claim 1, wherein each of the plurality of noise detectors is disposed to face an inside of the wall configuring the shell.

7. The noise reduction device according to claim 1, wherein each of the plurality of noise detectors is disposed at a periphery of a protrusion disposed in the seat.

8. The noise reduction device according to claim 1, wherein the control-sound generator is disposed so as not to protrude from the surface of the wall configuring the shell.

9. The noise reduction device according to claim 1, wherein the control-sound generator is disposed to face an inside of the wall configuring the shell.

10. The noise reduction device according to claim 1, wherein the control-sound generator is equipped with a mesh-like guard member integrated with a surface of the shell.

11. The noise reduction device according to claim 1, wherein the noise reduction device further comprises a case unit accommodating the control-sound generator, the case unit being shared by another one or more of said noise reduction devices disposed in another one or more of said shells disposed adjacent to each other.

12. The noise reduction device according to claim 1, wherein the noise reduction device further comprises a case unit accommodating the control-sound generator, the case unit being arranged out of the position relative to another case unit that accommodates the control-sound generator of another said noise reduction device.

13. The noise reduction device according to claim 1, wherein the plurality of noise detectors are disposed at distances from the control center, the distances being approximately equal to each other.

14. The noise reduction device according to claim 13, wherein the noise reduction device satisfies Relational Expression $$d\max - d\min < \lambda/2$$

where "dmax" is a distance from the control center to most distant one of the plurality of noise detectors;

"dmin" is a distance from the control center to closest one of the plurality of noise detectors; and "λ" is a wavelength corresponding to control upper-limit frequency "f" in the plurality of noise detectors.

15. The noise reduction device according to claim 13, wherein the plurality of noise detectors are disposed at approximately equal spacing-intervals.

16. The noise reduction device according to claim 1, wherein the noise controller performs feed-forward control.

17. The noise reduction device according to claim 1, wherein:

a plurality of control-sound generators are provided and disposed in the shell, and at least one of distances between two of the plurality of control-sound generators is not smaller than 136 mm and not larger than 451 mm.

18. The noise reduction device according to claim 1, wherein the second position is an end of a reclining range of the reclinable seat.

19. A noise reduction device used together with a shell surrounding at least a part of a periphery of a reclinable seat, the noise reduction device comprising:

a plurality of noise detectors for detecting a noise;

a noise controller for generating a control-sound signal to reduce, at a control center of a control space, the noise detected by the plurality of noise detectors; and a control-sound generator for outputting a control sound based on the control-sound signal, wherein each of the plurality of noise detectors is accommodated in a wall configuring the shell and is set back from a surface of the wall, and wherein the plurality of noise detectors includes one or more first noise detectors and one or more second noise detectors, each of the plurality of noise detectors detecting the noise, the one or more first noise detectors are disposed respectively at distances, from the control center, shorter than a distance "d" indicated by a Relational Expression $$d = d0 + t \times v - \lambda/2$$

where "λ" is a wavelength corresponding to control upper-limit frequency "f" in the plurality of noise detectors, "d0" is a distance from the control center to the control-sound generator, "t" is a control delay time in the control-sound generator, and "v" is a sound speed, the one or more second noise detectors are disposed respectively at distances, from the control center, longer than the distance "d," and a total number of the one or more first noise detectors is smaller than a total number of the one or more second noise detectors.

20. The noise reduction device according to claim 19, wherein the second noise detectors are disposed at approximately equal spacing-intervals.

* * * * *